US006917780B2

(12) United States Patent
Ozawa et al.

(10) Patent No.: US 6,917,780 B2
(45) Date of Patent: Jul. 12, 2005

(54) IMAGE FORMING APPARATUS THAT PREVENTS ATTACHMENT OF TONER TO LATERAL SIDES OF THE DEVELOPING ROLL

(75) Inventors: Yoshio Ozawa, Watarai-gun (JP); Eiji Ochiai, Watrai-gun (JP); Shoichi Sakata, Watarai-gun (JP); Toshinori Nishimura, Watarai-gun (JP); Masayoshi Yamada, Watarai-gun (JP)

(73) Assignee: Kyocera Corporation, Kyoto (JP)

( * ) Notice: Subject to any disclaimer, the term of this patent is extended or adjusted under 35 U.S.C. 154(b) by 32 days.

(21) Appl. No.: 10/173,416

(22) Filed: Jun. 13, 2002

(65) Prior Publication Data

US 2003/0049054 A1 Mar. 13, 2003

(30) Foreign Application Priority Data

| | | |
|---|---|---|
| Jun. 13, 2001 | (JP) | 2001-178356 |
| Jul. 4, 2001 | (JP) | 2001-202996 |
| Jul. 6, 2001 | (JP) | 2001-206331 |
| Jul. 6, 2001 | (JP) | 2001-206332 |
| Jul. 23, 2001 | (JP) | 2001-221413 |
| Oct. 17, 2001 | (JP) | 2001-319925 |

(51) Int. Cl.[7] ..... G03G 15/08
(52) U.S. Cl. ..... 399/282; 399/60; 399/285
(58) Field of Search ..... 399/279, 282, 399/285, 27, 30, 58, 60, 258, 49

(56) References Cited

U.S. PATENT DOCUMENTS

| | | | | | |
|---|---|---|---|---|---|
| 4,385,829 | A | * | 5/1983 | Nakahata et al. | 399/282 |
| 4,669,852 | A | * | 6/1987 | Tajima et al. | 399/282 |
| 5,581,326 | A | * | 12/1996 | Ogata et al. | 399/30 |
| 5,991,587 | A | * | 11/1999 | Kikuchi | 399/282 |
| 6,035,169 | A | * | 3/2000 | Miyake et al. | 399/258 |

FOREIGN PATENT DOCUMENTS

| | | | | |
|---|---|---|---|---|
| JP | 05053423 | A | * 3/1993 | G03G/15/06 |
| JP | 09311548 | A | * 12/1997 | G03G/15/08 |

* cited by examiner

*Primary Examiner*—Robert Beatty
(74) *Attorney, Agent, or Firm*—Schulte Roth & Zabel LLP; Joel E. Lutzker; Mayankkumar Dixit

(57) ABSTRACT

An image forming apparatus of non-contact developing method using two-component developer material which is capable of obtaining a clear image free from fogging, ghost and toner contamination. The image forming apparatus has at least one developing unit which includes a developing roll and a magnetic roll, the developing unit develops an electrostatic latent image on a photosensitive body with a toner thin layer formed on the surface of a developing roll wherein a toner thin layer forming region on the developing roll is smaller than a magnetic brush forming region on the magnetic roll. A high resistivity region is adjacent each end of the toner thin layer forming region on the developing roll. A control device controls a developer material replenishment and controls the biasing to the developing roll and magnetic roll.

15 Claims, 20 Drawing Sheets

IMAGE FORMING APPARATUS THAT PREVENTS ATTACHMENT OF TONER TO LATERAL SIDES OF THE DEVELOPING ROLL

BACKGROUND OF THE INVENTION

1. Field of the Invention

The present invention relates to an image forming apparatus utilizing electro-photography such as a copying machine, a printer, a facsimile machine or a machine having a combination thereof. More particularly the present invention relates to an image forming apparatus capable of maintaining a stable image for a long time by preventing fluctuation of the image depth caused by developing history or successive printing in a hybrid developing system that develops a latent image on an electrostatic latent image bearing body (a photosensitive body) by flying the charged toner to jump thereto from a developing roll which holds charged toner selectively using a two component developer material which charges non-magnetic toner by means of a magnetic carrier.

2. Description of the Related Art

Heretofore, a non-contact, one component developing method which develops a latent image on an electrostatic latent image bearing body (a photosensitive body) by causing the charged toner to jump thereto from a developing roll which holds charged toner selectively using a two component developer material which charges non-magnetic toner by means of magnetic carrier has been investigated. Recently, however, a similar method has been investigated as a method capable of forming the image rapidly, particularly as a single-roll-pile-up-color method by which a plurality of color images are piled up on an electrostatic latent image bearing body (a photosensitive body). The method attracts attention as a technique for high quality color images because piling the toners precisely up on the electrostatic latent image bearing body can form a color image of minimum color drift.

Recently, a so called tandem method has attracted attention because of its high printing rate, by which color layers are piled on a recording sheet using a plurality of photosensitive bodies, each body corresponding to each color of the multi-colors, by forming color images thereon synchronized with the transfer of the sheet. Although the method has an advantage in its high printing rate, the apparatus tends to be large-sized because each electro-photographic process member of each color needs to be disposed in rows. To cope with this disadvantage, a compact tandem type image forming apparatus having a small-sized image forming unit wherein the distances among the photosensitive bodies in the array are shortened has been proposed.

In a compact tandem type image forming apparatus that is constructed in this way, it is favorable that a developing unit is vertical in order to minimize the latitudinal size of the image forming unit. In other words, it is preferable to dispose the developing unit above the photosensitive body in light of layout. Nevertheless, problems are that, in the case of the vertical arrangement of the developing unit in the conventional two component developer material method, assembling of the apparatus to a compact body is limited and at the same time, it is inevitable that carrier attaches the photosensitive body and toner scatters owing to lowering of charge on the toner because supplying developer material from a developer stirring part to a developing member adjacent to the photosensitive body, i.e. a reflux of developer material, becomes complicated.

Though one component method without carrier is proposed as another method, torque fluctuation of a rotational photosensitive body by contacting a developing roll to a photosensitive body results in color drift which is a drawback in a tandem method. In a method in which a photosensitive body is not touched, toner is charged with a charge roll and an elastic restricting blade defines a layer thickness on the developing roll. Therefore, toner additives adhere to the charge roll to lower charge capability or toner adheres to the restricting blade to form an uneven layer. These result in image defects.

As a measure to solve these problems, a hybrid developing method has been proposed wherein toner is charged using an aforementioned two-component developer material and the toner alone is flown to a photosensitive body without subsequent contact. An example of such prior art is disclosed in U.S. Pat. No. 3,866,574, in which the inventor proposed that a thin layer of non-magnetic toner was formed on a donor roll (developing roll) disposed so as not to come in contact with an electrostatic latent image bearing body (a photosensitive body) and then the toner was caused to jump to a latent image on the electrostatic latent image bearing body (the photosensitive body) by an alternating current electric field. Further, U.S. Pat. No. 3,929,098 discloses a hybrid developing unit wherein a toner layer is formed on a donor roll by advancing developer material onto a donor roll to transfer thereon.

Toshiba Corporation reported a theoretical aspect of formation of toner layer on a developing roll using two component developer material in the Journal of the Imaging Society of Japan, Vol. 19, No. 2, 1981 and the art is filed and disclosed on Japanese laid-open patent, JP1984-121077.

Nevertheless, these arts need strong alternating current electric field in order to overcome the difficulty in separating toner on the roll when the electric charge of the toner becomes high, although formation of a thin layer on the donor roll is possible by adopting the two component developer material method. The strong alternating current electric field disorders the toner layer on the electrostatic latent image bearing body (the photosensitive body) so that difficulty arises in color pile up. Considering the overcoming of this drawback, a so-called powder cloud developing method is proposed in Japanese laid-open patent, JP1992-113474, in which an auxiliary electrode is provided to apply a weak alternating current electric field so as not to disorder the developed toner image. The aforementioned prior arts need complicated control of electrification such as application of high surface potential and strong developing electric field on the photosensitive body. Hence, when both toner consuming region and toner non-consuming region are generated, adhering states of toner and toner potentials disperse on the roll so that a hysteresis tends to occur, that is a phenomenon in which a ghost image of a part of a previous developing image appears on successive developing images as shown in FIG. 4. In FIG. 4, 13 is a solid image consisting of a rectangular solid black and 16 is a successive half tone image broader than the solid image. In case a toner consuming region and a toner non-consuming region are generated on the developing roll, a ghost image 14A shown in FIG. 4(*b*) appears when printing the half tone image 16 after the solid image 13.

To avoid this defect, Japanese laid-open patent publication, JP1999-231652 discloses a member for scraping residual developing toner on the developing roll and an apparatus for recovering the scraped toner. Further, as a method for recovering completely toner on the developing roll, Japanese laid-open patent publication, JP2000-81788 discloses a recovery roll for sole use in recovery. Further, a method for stabilizing charge on toner by recovering toner on the developing roll to a magnetic roll by means of potential difference to stabilize the charge of toner utilizing a passing moment between a copying process and another successive copying process or a moment between the passing of successive sheets.

Japanese laid-open patent publication JP1995-12898 discloses a measure for a hysteresis when using a magnetic brush, which includes a proposal to recover and supply toner on a developing roll by setting the width of the region of half value of magnetic flux density on the magnetic roll to be broad. A control method for a tandem type developing unit disclosed in Japanese laid-open patent publication JP1988-249164 includes a method for preventing deterioration of developer material by interrupting the operation of developing units in image forming parts except for the image forming part which is conducting a transfer process. Japanese laid-open patent publication JP1994-67546 discloses the art of a high frequency voltage application where a high frequency electric field to supply toner to a developing roll from a magnetic roll or a high frequency electric field to exfoliate toner from the developing roll to deliver thereof to the magnetic roll is alternately formed by applying alternately a high frequency electric voltage between the developing roll and the magnetic roll, and the art of recovering toner on a developing roll where toner on the developing roll is recovered by exfoliating electrically with an exfoliating member provided adjacent to a magnetic roll and followed by returning the recovered toner to the magnetic roll.

The powder cloud developing method disclosed in the aforementioned Japanese laid-open patent publication JP1991-113474 has not been, however, paid general attention because a wire for the auxiliary electrode is apt to get dirty and image deterioration occurs by vibration. The apparatuses disclosed in Japanese laid-open patent publications JP1999-231652, JP1995-72733, JP 1995-92804, JP1995-128983, JP1984-121077 and JP2000-81788 have such drawbacks as prerequisites for a member for scraping toner or a recovery roll, as a potential cause for deteriorating durability performance of toner owing to increasing stress of toner by applying special recovery bias voltage and as a loss of speed because of the necessary time for formation of a layer on the developing roll at the successive developing process. These prior arts also have a cause of scatter of toner or fogging owing to insufficient electric charge by broadening a charge distribution of replenished toner or recovered supplied toner, as charge characteristic of toner on the developing roll varies to a large extent by deterioration of durability performance of toner when it is used for a long time. Moreover, as it is troublesome to change deteriorated carrier, the arts have actually been of no practical use.

Apparatuses disclosed in Japanese laid-open patent publication JP1988-249164 and JP1994-67546 necessitate such an apparatus or a control as interrupts operation of developing units other than the developing unit of an image forming part which is under transfer process or as shifts high tension high frequency voltage applied between the developing roll and the magnetic roll. At the same time, the developing unit is constructed so that the toner roll, the magnetic roll and the stirring member are arrayed laterally, which results in difficulty in achieving a compact design.

Furthermore, in these conventional arts, the amount of toner in the toner layer on the developing roll varies when the second developing cycle is brought into operation after the first developing cycle together with a phenomenon which brings about a decline of image depth in the second developing cycle or the later cycle after a deep color developing owing to an insufficient amount of toner. In order to avoid these phenomena, such means may be devised as ensure a sufficient amount of toner by idling the developing roll until the forthcoming developing period or ensure an idle period between successive developing periods. These means do not solve the aforementioned problems as the charge of the toner declines on account of an increase in the load on the developer material if the developing roll runs fast or if the machine is left idle for a considerable length of time.

These conventional arts have a drawback of a possible hysteresis, which means the appearance of a ghost image as shown in FIG. 4(*b*), to overcome.

In one of the improvements on these conventional arts, the occurrence of the hysteresis is avoided as recovering residual toner on the developing roll to the magnetic roll by applying a potential difference between the developing roll and the magnetic roll at an image-non-forming period, which is the reverse to that at an image-forming period. It is true that to apply a potential difference between both rolls is effective to recover the residual toner on the developing roll to the magnetic roll and the greater the potential difference the easier the residual toner can be recovered.

However, the developing roll needs to rotate in order to recover a lot of layers of toner particles with regard to the mean diameter of toner particles by sticking the residual toner to the carrier of the magnetic brush formed on the magnetic roll. Thus, the residual toner is recovered by rotation of both rolls.

If that is the case, contacting occasions of the magnetic brush to the developing roll can increase by setting a circumferential rotational speed of the magnetic roll greater than that of the developing roll. In addition, the adhesion power of the toner on the developing roll thereto can be diminished as a shear stress by the magnetic brush affecting to the residual toner on the developing roll is strengthened.

As a result, a strongly magnetic carrier can effectively recover the residual toner at an equal potential without applying a potential difference between the developing roll and the magnetic roll. The inventors paid attention to this fact.

Nevertheless, as shown in FIG. 17(*b*), when an image is formed on a recording sheet 17 shown in (a) where a toner layer is formed in the height direction on a developing roll 32 having a width of $H_1$ and a magnetic brush is formed in the height direction on a magnetic roll 31 having the same width of $H_1$, and both rolls are disposed at the same position in developing vessels 12*a* and 12*b*, ghost images 14B, 14C are formed on both edges.

Referring to FIG. 16(*a*) and 16(*b*), it is understood that though a residual toner after developing 15*a* is recovered by a carrier 24$A_1$, a residual toner after developing 15*b* is recovered by a carrier 24$A_2$ and a residual toner after developing 15*c* is recovered by a carrier 24$A_3$ in case the developing roll and the magnetic roll are disposed at the same height and at the same size as shown in FIG. 16(*a*), in case the width in the direction of height of the developing roll 2 is higher than that of the magnetic roll 1, the toner 15*c* is recovered by the carrier 24B while the toner 15*a* and 15*b* are not recovered because magnetic brushes are not formed at the position higher than that of carrier 24B as shown in 16(*b*).

Thus, the residual toners after developing 15*a*, 15*b* and 15*c* can be recovered by carriers 24$C_2$, 24$C_3$ and 24$C_4$ of the corresponding magnetic brushes by means of forming the width in the direction of a sleeve axis $H_3$ of the magnetic brush on the magnetic roll comparatively longer than the width in the axial direction $H_1$ of the toner layer on the developing roll.

Toners 15*d*, 15*e* and 15*f* of carriers on the magnetic brush jump to and are caught on a lateral side of the developing roll by a potential difference applied between the developing roll and the magnetic roll when forming an image. When not forming an image, the residual toners 15*a*, 15*b* and 15*c* are recovered by the magnetic brush while the toners 15*d*, 15*c* and 15*e* do not touch the magnetic brush to remain unrecoverable, which results in contaminating the inner of the apparatus by scattering.

However, the apparatuses disclosed in Japanese laid-open patent publication JP1999-231652 and JP1996-128983 have a cause to deteriorate durability of toner owing to increasing stress to toner by a toner scraper or application of special bias for recovering toner. These prior arts also have a cause of scatter of toner or fogging owing to insufficient electric charge by broadening a charge distribution of replenished toner or recovered supplied toner, as charge characteristic of toner on the developing roll varies to large extent by deterioration of durability performance of toner in case of using for a long time. Moreover, it is troublesome to change deteriorated carrier so that the arts have actually been of no practical use.

Hybrid type developing units disclosed in Japanese laid-open patent publication JP1994-67546, JP1995-72733 and JP1995-792804 include a powder cloud developing method having an electrode provided between a donor roll and a latent image bearing body (photosensitive body). The method has a drawback that a wire for the electrode is apt to get dirty and has a possibility of image deterioration by vibration. In a developing unit disclosed in Japanese laid-open patent publication JP1995-72733 or JP1995-92804, a toner layer on a developing roll is formed by applying a definite voltage from a magnetic brush so that an electric charge of toner on the developing roll becomes higher in comparison with that of toner in the magnetic brush (in the two component developer material) as repeatedly receiving electric field or friction from the magnetic brush in case of such as a successional printing. In the developing unit, toner on the developing roll is recovered by scraping by the magnetic brush practically without replacing with the toner in the magnetic brush so that the recovery process can be carried out in a short time. Contrary to that, a charge distribution of the toner in two component developer material becomes broad, even generating reversely charged toner for the toner on the developing roll having different charge mixes instantaneously with the toner in the magnetic brush, which brings about disadvantages such as increasing scattering of toner from the magnetic brush or image defect.

An apparatus disclosed in Japanese laid-open patent publication JP2000-250294 or JP2000-250295 includes a developing unit which carries out hybrid development by generating a toner cloud with an electrode embedded in a donor roll (developing roll). It has such complicated construction that brushes for applying charge to electrodes are provided in two places where toner is filed to the donor roll from developing place and the magnetic roll. This pushes up the manufacturing cost for the apparatus.

SUMMARY OF THE INVENTION

The present invention has been made to solve the aforementioned problems and has an object of providing an image forming apparatus of non-contact developing method utilizing two component developer material, more particularly providing an image forming apparatus capable of forming a clear image by suppressing generation of ghost and avoiding fogging.

Another object of the present invention is to provide an image forming apparatus capable of preventing attachment of toner to the lateral side of a developing roll from a magnetic roll.

Further, the present invention provides a method of developing capable of constructing a compact hybrid type developing unit suitable for a compact tandem image forming apparatus which offers stable image quality for a long time as well as an image forming apparatus including a hybrid type developing unit capable of maintaining stable image quality for a long time by keeping a toner amount of the toner layer on a developing roll constant without complicating the developing unit, by supplying surely charged toner to prevent the generation of ghost images at a succession of developing, by avoiding fluctuation of toner amount on the developing roll and lowering of image depth, whereby a low-cost and compact tandem image forming apparatus can be constructed.

A further object of the present invention is to provide an image forming apparatus whereby a stable image quality can be obtained for a long time by preventing the generation of ghost images at a succession of developing without complicating a developing unit and by supplying surely charged toner to a developing roll, particularly to provide a tandem type image forming apparatus capable of constructing a compact process unit.

The other object of the present invention is to provide a tandem type image forming apparatus obtainable of always stable color images by releasing deteriorated toner from the process unit before image deterioration, though, in the conventional apparatus, the charge of developer material increases to vary a developing amount of toner in case of printing successively a extreme low printing rate image or in case of printing a single specific color.

The other object of the present invention is to provide an image forming apparatus having a means for replenishing the developer material to a developing unit and a means for controlling the replenishing means wherein declining of image depth and fogging are prevented as well as toner is not wasted.

In order to attain the aforementioned objects, the present invention is featured that, in an image forming apparatus having at least one developing unit which develops an electrostatic latent image on a photosensitive body with a thin layer of toner formed on the surface of a developing roll charged with a developing bias through a magnetic brush consisting of high resistivity or insulator toner and carrier, a region for forming a toner thin layer in the axial direction on the surface of the developing roll is smaller than a region for forming the magnetic brush in the axial direction on a magnetic roll.

According to the invention, as a region for forming a toner thin layer in the axial direction on the surface of the developing roll is smaller than a region for forming the magnetic brush in the axial direction on the magnetic roll, a toner thin layer sufficiently covering a region of an electrostatic latent image formed on the photosensitive body can be prepared on the surface of the corresponding developing roll.

On the contrary, if a region for forming the magnetic brush in the axial direction on the magnetic roll is smaller than a region for forming a toner thin layer in the axial direction on the surface of the developing roll, a uniform toner thin layer can not be prepared because the magnetic brush is disordered at both ends of the developing roll when forming an image.

When an image is not formed, the magnetic brush of the magnetic roll does not brush the region of toner thin layer on the developing roll corresponding to all the electrostatic latent images; thus a part that has not been brushed by the magnetic brush remains on the developing roll without recovering to generate a ghost image at the formation of the image.

According to the present invention, as a region for forming the magnetic brush in the axial direction on the magnetic roll is greater than a region for forming a toner thin layer in the axial direction on the surface of the developing roll, a toner thin layer sufficiently covering a region of an electrostatic latent image formed on the photosensitive body can be prepared on the surface of the corresponding developing roll so as no to be insufficient in terms of supplying toner at the outsides in the direction of the width of the region of the electrostatic latent image formed on the photosensitive body when forming an image to form perfectly the image and, at the same time, so as not to generate a ghost image owing to incomplete recovery of the residual toner on the developing roll.

It is preferable to form a toner thin layer non-forming region consisting of an insulator region or a high resistivity region higher than toner resistivity at both sides of the region for forming toner thin layer.

According to such technical means, since a toner thin layer non-forming region consisting of an insulator region or a high resistivity region higher than toner resistivity at both sides of the region for forming toner thin layer is formed so that toner does not stick to said both sides, an excellent quality image can be formed preventing malfunctioned image formation owing to the adhered toner's adhering to the photosensitive body or owing to its contaminating to the inner of the apparatus.

It is preferable to construct such that the toner thin layer is formed on the developing roll by potential difference formed between the developing roll and the magnetic roll at the image forming period and the residual toner on the developing roll is recovered with a magnetic brush of the magnetic roll having a peripheral rotating speed thereof greater than that of the developing roll at the image non-forming period.

According to such technical means, when image is not formed, the residual toner on the developing roll is recovered with the magnetic brush of the magnetic roll having a circumferential rotational speed thereof greater than that of the developing roll at the image non-forming period in the state of zero potential difference formed between the developing roll and the magnetic roll.

By rotating the rolls with the circumferential rotational speed of the magnetic roll greater than that of the developing roll, the occasion for the magnetic brush to contact the developing roll increases; in addition, a shear stress of the magnetic brush also increases to affect the residual toner on the developing roll. Accordingly, a pressing force to the developing roll of the residual toner on the developing roll decreases to be able to recover effectively the residual toner by the high magnetic carrier at the equal potential.

The spacing between the photosensitive body and the developing roll set to be 150 to 400 micrometers ($\mu$m) together with the toner thin layer formed from the magnetic roll to the developing roll at the image forming period to be a thickness of 5 to 10 times the average diameter of the toner particles are effective means for the present invention.

According to such technical means, the spacing between the photosensitive body and the developing roll is set to be 150 to 400 micrometers because fogging occurs easily when the spacing is narrower than 150 micrometers while it is difficult to cause toner to jump across to the photosensitive body so that a sufficient image depth cannot be obtained when the spacing is broader than 400 micrometers.

The toner thin layer is formed from the magnetic roll to the developing roll at the image forming period to be a thickness of 5 to 10 times of the average diameter of the toner particles so as to be 35 to 70 micrometers thick suppose the average diameter of the toner particles is 7 micrometers because it is difficult to supply toner to the photosensitive body so that the difference of the image depth occurs or a ghost image appears since the developing residual toner can not be recovered thoroughly if the thickness of the toner thin layer exceeds 70 micrometers.

It is preferable to set an average diameter of the carrier particles 3 to 9 times that of the toner particles. If the average diameter of the carrier particles is smaller than 3 times that of the toner particles, then it is difficult to recover toner because the attractive force to absorb is weak; if the average diameter of the carrier particles is larger than 9 times that of the toner particles, then a longer time for recovering toner is necessary because the carrier particles have less occasions on which to contact toner particles.

It is also preferable to form the toner thin layer of thickness of 5 to 10 times the average diameter of the toner particles by applying 100 to 250 volts of a developing bias between the magnetic roll and the developing roll.

According to such technical means, a toner thin layer corresponding to a thickness of 5 to 10 times the average diameter of toner particles can be prepared on the developing roll at the image forming period. Thus, it is possible to form an image having an appropriate depth without a ghost image or a fogging image as well as a toner thin layer appropriate for recovering the residual developing toner.

Further, the present invention features that in an image forming apparatus, according to claim 1, where the developing bias is a developing bias of a first direct current bias added by an alternating current bias and the applied bias of the magnetic roll is a second direct current bias, when a toner thin layer used in developing a latent image on a photosensitive body is formed, a potential difference between the first direct current bias and the second direct current bias at a toner thin layer forming period of a first round of rotation is set larger than that at a toner thin layer forming period of a second and after the second round of rotation.

With a potential difference between the first direct current bias and the second direct current bias at a toner thin layer forming period of a first round of rotation larger than that at a toner thin layer forming period of a second and after the second rounds of rotation, a phenomenon that a toner amount of the toner layer of the developing roll in the entering stage of the second round of development varies from that of the first round and a phenomenon that decline of the image depth brought about due to lack of the absolute amount of toner at the second and after the second rounds can be prevented from securing a sufficient amount of toner to develop for the first round of the developing roll; likewise, a decline of the image depth due to an insufficient amount of toner is avoided even after development of a high image depth.

Owing to the above, appearance of the ghost image at successive printing or variation of toner amount is prevented as properly charged toner is supplied to the developing, so that a developing unit capable of maintaining stable image quality for a long time can be provided whereby a tandem image forming apparatus whose image quality is stabilized can be constructed compactly and at low cost.

According to the present invention as described in claim 2, a potential difference between the first direct current bias and the second direct current bias at a first round of rotation and a potential difference at a second and subsequent rounds of rotation is approximately 45 to 55 volts.

If a potential difference of the first round, which is larger than that of the second and subsequent rounds, is set to be larger than 55 volts, toner scatters due to the increased amount of toner on the developing roll; if the potential difference is smaller than 45 volts, a remarkable effect is not found. By setting the voltage at approximately 50 volts (45 volts to 55 volts), however, such a phenomenon can be prevented so that toner layer necessary for development at the first round of developing roll can be secured as well as preventing the decline of image depth due to lack of the absolute amount of toner even after developing a deep color image.

It is preferable that, as for the potential deference between the first and the second direct current bias, an equal potential state is generated by rotating the developing roll and the magnetic roll at an image non-forming period such as a period before and after forming an image and a space of recording media on a successive image forming, and, at the same time, only an alternating current bias is applied, whereby the toner on the developing roll is exchanged by means of the magnetic brush together with the alternating current bias.

Thus, by generating an equal potential state as for the potential deference between the first and the second direct current bias is generated as rotating the developing roll and the magnetic roll at an image non-forming period, and by applying only an alternating current bias at the same time, residual toner after developing is able to be recovered with the brush effect due to a difference of the circumferential rotating speeds of the rolls as the magnetic brush contacts the toner layer on the developing roll, and developer material can also be exchanged by stirring with a mixer, without providing an additional apparatus such as a scraper blade or without giving the toner a lot of load. Hence, a clear image can be formed, as residual toner, which is a cause of a ghost image, is easily recovered and preventing appearance of a ghost image while avoiding the generation of fogging.

The present invention features that in an image forming apparatus, according to claim 1, where the developing bias is a developing bias of a first direct current bias added by an alternating current bias and the applied bias of the magnetic roll is a second direct current bias, an equal potential state of the first and the second direct current bias is generated as rotating the developing roll and the magnetic roll at a period before and after forming image or/and at an image non-forming period such as a period between a image forming period and the next successive image forming period or a space of recording media on a successive image forming, and, at the same time, only an alternating current bias is applied, whereby the toner on the developing roll is exchanged by means of the magnetic brush together with the alternating current bias.

Thus, by applying only an alternating current bias by means of generating an equal potential state of the equalized surface potential of the both rolls as rotating the developing roll and the magnetic roll at an image non-forming period, toner on the developing roll is not recovered only with the magnetic brush but the exchange of toner on the developing roll to toner in the magnetic brush is promoted, and at the same time, a variation of a toner charge distribution is almost removed, whereby the generation of ghost images is prevented at a succession of developing, properly charged toner is supplied to the developing roll and stable image quality is obtained for a long time.

The alternating current bias applied on the developing roll has a rectangular wave having a positive duty ratio less than 45% when using positive charged toner or a negative duty ratio less than 45% when using negative charged toner whereby toner on the developing roll is effectively exchanged, problems such as sticking toner to the developing roll, developing ghost and scattering of toner are dissolved, generation of ghost images at the successive developing is prevented without complicating the developing unit and properly charged toner can be supplied to the developing roll.

And by controlling a length between the recording media longer than the process circumferential length of the developing roll, exchange between the toner on the developing roll and the toner in the magnetic brush can be promoted even between the recording media whereby stable image quality is maintained during successive printing.

In order to promote exchange between the toner on the developing roll and the toner in the magnetic brush, a rotating speed of the magnetic roll is brought to be faster than the rotational speed of the developing roll and by means of rotating both rolls in the same direction and contacting the magnetic brush to the developing roll, toner on the developing roll is exchanged whereby the effective of exchanging toner is ensured.

Further, according to the present invention, in a tandem type image forming apparatus having a plurality of sets, with respect to the corresponding plurality of colors, of the developing units defined in claim 1 and the corresponding photosensitive drums, which forms a image by transferring each colored image from each process unit to a recording medium or an intermediate transfer body, the residual toner on the developing roll is recovered by means of the magnetic brush at the equal potential state of both roll which are equalized with the potential between the two as rotating the developing roll and the magnetic roll before beginning to form image.

Thus, the magnetic brush formed on the magnetic roll recovers all of the toner on the developing roll by bringing both rolls to a state of equal potential, in which a potential between the two rolls is equalized as rotating the developing roll and the magnetic roll at the image non-forming period or before beginning to form an image so that developing a hysteresis on the developing roll is avoided and the formation of a ghost image or fogging is prevented whereby stable image quality is obtained for a long time and a process unit can be compactly constructed, which makes possible a compact tandem image forming apparatus.

In this case, according to the present invention, it is preferable that if toner consumption falls below the prescribed amount, toner is forcibly discharged to the recording medium or the intermediate transfer body from the process unit at the development in each process unit.

Accordingly, in case an image of extreme low printing ratio is printed successively or an image of only restricted color is printed, variation of developing amount due to increase of charge on developer material is prevented and deteriorated toner is discharged from the process unit before image distortion occurs to obtain stable image quality for a long time by discharging toner forcibly to a recording medium or an intermediate transfer body from a process unit if toner consumption falls below the prescribed amount in each process unit.

Further, according to the present invention, it is preferable that toner is forcibly discharged to a recording medium or an intermediate transfer body from a process unit on account of increasing toner charge when a toner permeability sensor indicates a value below the definite value for an amount of toner consumption by presuming an amount of toner consumption from a dot amount of an image data which prints an amount of toner consumption.

Toner charge (hereinafter referred to as Q/M) increases to adhere tightly with electrostatic force to the surface of the carrier and an amount of toner consumption is estimated less than actual amount on account of a toner concentration (T/C) sensor's lowering of the out put value of permeability of the developer material, which results in malfunctioned supply of toner. By carrying out the process in the aforementioned way, the drawback is avoided and stable image quality is obtained for a long time. In addition, a compact process unit is constructed whereby a tandem image forming apparatus itself can be constructed compactly.

With regard to these controls, it is preferable to measure an amount of toner by each color discharged to the recording medium or the intermediate transfer body with a means for detecting a developing amount. If there is a plurality of process units whose toner consumption fall below the definite amount of toner consumption, it is preferable to transfer as a state of color piling on the recording medium or on the same position of the intermediate transfer body where paper is not passed.

Discharged toner amount is always found and the control can also be conducted even when toner is discharged from a plurality of the process units.

Further, according to the present invention, in an image forming apparatus having a replenishing means to replenish the developer material to the developing unit defined in claim 1 and a control means to control the replenishing means, the control means comprises an accumulating means which obtains an accumulated image density by accumulating image densities obtained by measuring each image density of each recording paper based on an image data, estimating means which estimates the amount of the developer material consumption in compliance with the accumulated image density, and prohibiting means which prohibits replenishing the developer material by the replenishing means for a prohibited time until the amount of consumption gets to a prescribed amount.

Since, in the above described apparatus for controlling replenishment of developer material, replenishment of developer material is prohibited until the amount of consumption gets to a prescribed amount by estimating the amount of the developer material consumption in compliance with the accumulated image density which have been obtained by accumulating image densities acquired from the image data, old developer material is consumed for the period of prohibition and new developer material is supplied after the period of prohibition so that new developer material is supplied to right near a developer material bearing body, whereby decline of image depth and fogging of image are prevented and besides, developer material is used effectively.

Further, according to the present invention, in an image forming apparatus having a replenishing means to replenish developer material to the developing unit defined in claim 1 and a control means to control the replenish means, the control means comprises an accumulating means which obtains an accumulated image density by accumulating image densities obtained by measuring each image density of each recording paper based on an image data and a prohibiting means which prohibits replenishing the developer material by the replenishing means for a prohibited time until the accumulated image density gets to a prescribed value.

Since, in the above described apparatus for controlling replenishment of developer material, replenishment of developer material is prohibited until the accumulated image density gets to a prescribed value by obtaining the accumulated image density by accumulating image densities acquired from the image data, old developer material is consumed for the period of prohibition and new developer material is supplied after the period of prohibition so that new developer material is supplied to right near a developer material bearing body, whereby decline of image depth and fogging of image are prevented and besides developer material is used effectively.

The accumulating means calculates the accumulated image density based on the equation, the image density×the number of printed sheets.

Further, according to the present invention, in an image forming apparatus having a replenishing means to replenish developer material to the developing unit defined in claim 1 and a control means to control the replenishing means, the control means comprises a replenishing means which replenishes developer material to the developing unit by controlling the replenish means when the detected developer material amount is less than a prescribed amount by detecting the amount of developer material in the developing unit as a detected developer material amount and a prohibiting means which prohibits replenishing the developer material by the replenishing means for a prohibited time until the amount of consumption gets to a prescribed amount by estimating the amount of the developer material consumption in compliance with the accumulated image density obtained by accumulating image densities which is further obtained by measuring each image density of each recording paper based on an image data.

In the above described developer material replenishing and controlling apparatus, the replenishing and controlling means replenishes developer material into the developing unit when the detected developer material amount is less than a prescribed amount and the prohibiting means prohibit to replenish developer material until the amount of consumption gets to a prescribed amount by estimating the amount of the developer material consumption based on the accumulated image density obtained from the image data. Accordingly, since old developer material is consumed for the prohibiting period and developer material is replenished after the prohibiting period under the control of the replenish and control means, new developer material is supplied after the period of prohibition so that new developer material is supplied to right near a developer material bearing body, whereby decline of image depth and fogging of image are prevented. Moreover, as old developer material is consumed without dummy development, developer material is not wasted.

Besides, according to the present invention, in an image forming apparatus having a replenishing means to replenish developer material to the developing unit defined in claim 1 and a control means to control the replenishing means, the control means comprises a replenishing control means which replenishes developer material to the developing unit by controlling the replenishing means when the detected developer material amount is less than a prescribed amount by detecting the amount of developer material in the developing unit as a detected developer material amount and a prohibiting control means which prohibits replenishing the developer material by the replenishing means for a prohibited time until the accumulated image density gets to a prescribed value by obtaining the accumulated image density by accumulating image densities which obtained by measuring each image density of each recording paper based on the image data.

In the above described developer material replenishing control apparatus, the replenishing control means replenishes developer material into the developing unit when the detected developer material amount is less than a prescribed amount and the prohibiting control means prohibits replenishing the developer material until the accumulated image density gets to a prescribed value by obtaining the accumulated image density by accumulating image densities which obtained from the image data. Accordingly, since old developer material is consumed for the prohibiting period and developer material is replenished after the prohibiting period under the control of the replenish and control means, new developer material is supplied after the period of prohibition so that new developer material is supplied to right near a developer material bearing body, whereby decline of image depth and fogging of image are prevented. Moreover, as old developer material is consumed without dummy development, developer material is not wasted.

For example, the prohibiting control means calculates the accumulated image density based on the equation, the image density×the number of printed sheets. When the image forming apparatus starts to run, the replenishing control means is activated to activate the prohibiting control means by the time the number of printing sheets with the image forming apparatus come to a prescribed number. It may also enforceable that when the image forming apparatus starts to run, the replenishing control means is activated so as to activate the prohibiting control means by the time the image density comes to a prescribed density.

Thus, if the prohibiting control means is activated by the time the number of printing papers come to a prescribed number with activation of replenishing control means in the first place or by the time the image density comes to a prescribed density, developer material of large particle size (such as old developer material) is consumed during the prohibiting period so that new developer material is supplied to the right near developer material bearing body when developer material is replenished to the developing unit under the control of replenishing control means after the prohibiting period so as to be able to prevent decline of image depth and image fogging. Furthermore, as old developer material is consumed with out dummy developing, developer material is not wasted.

The prohibiting period is defined based on a ripple ratio generated in the developing unit, such as with the ripple ratio of 5 to 50% range. Regarding the developing unit, a latent image is developed by, such as a magnetic one component developing method.

According to the developer material replenishing control of the present invention, a ripple of the amount of developer material in the developing unit is generated. And, owing to the ripple in the developing unit, newly replenished developer material is quickly transferred to near the developer material bearing body. As a result, new developer material is supplied to the developer material bearing body while old developer material is consumed so that decline of image depth and image fogging can be prevented. It is preferable that the ripple ratio of developer material is within the range of 5 to 50% to developer material in the developing unit. If the ripple ratio of developer material is less than 5%, it is difficult to avoid a selective phenomenon. If the ripple ratio of developer material is more than 50% on the other hand, a prohibiting period of developer material replenishment is prolonged so that it becomes difficult to form a thin layer of developer material on the developer material bearing body.

DETAILED DESCRIPTION OF PREFERRED EMBODIMENTS

The invention will now be described below in detail by way of example with reference to the accompanying drawings. It should be understood, however, that the description herein of specific embodiments such as to the dimensions, the kinds of material, the configurations and the relative disposals of the elemental parts and the like is not intended to limit the invention to the particular forms disclosed but the intention is to disclose for the sake of example unless otherwise specifically described.

This patent application claims priority from Japanese Application Number 2001-178356, Japanese Application Number 2001-202996, Japanese Application Number 2001-206331, Japanese Application Number 2001-206332 and Japanese Application Number 2001-319925 that are incorporated by reference herein in their entirety.

Figure 1:
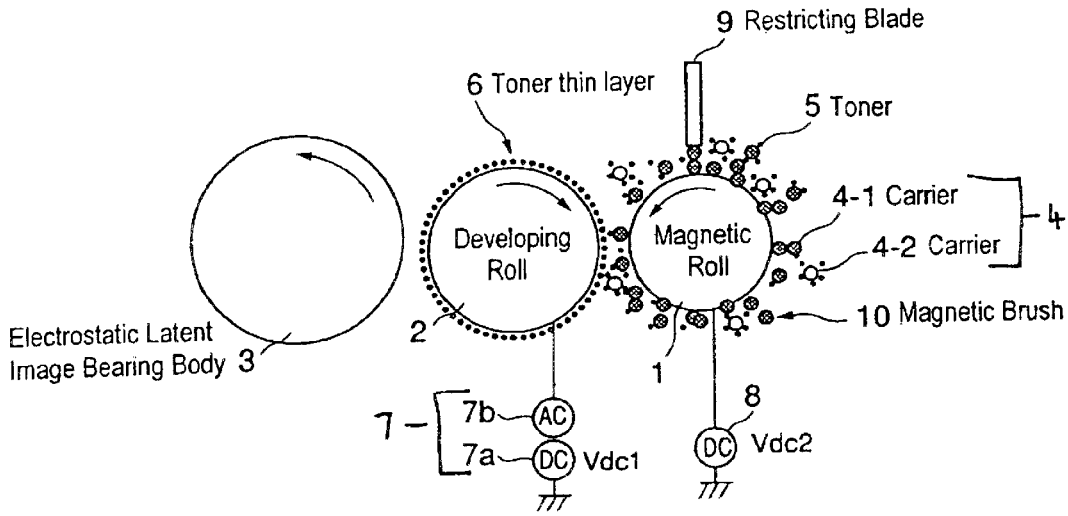
FIG. 1 is a schematic drawing illustrating a developing apparatus in a process unit used in a tandem type image forming apparatus according to one embodiment of the present invention.
Figure 2:
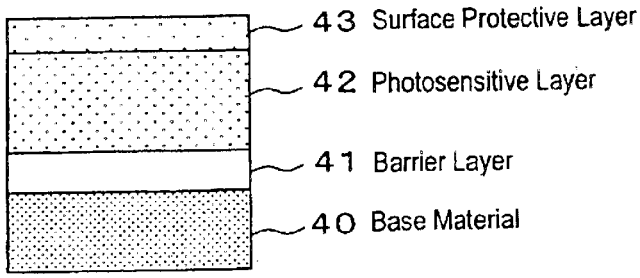
FIG. 2 is a sectional view showing a fundamental layer constructive model consisting of a-Si (amorphous silicon) on an electrostatic latent image bearing body (photosensitive body) used in the present invention.
Figure 3:
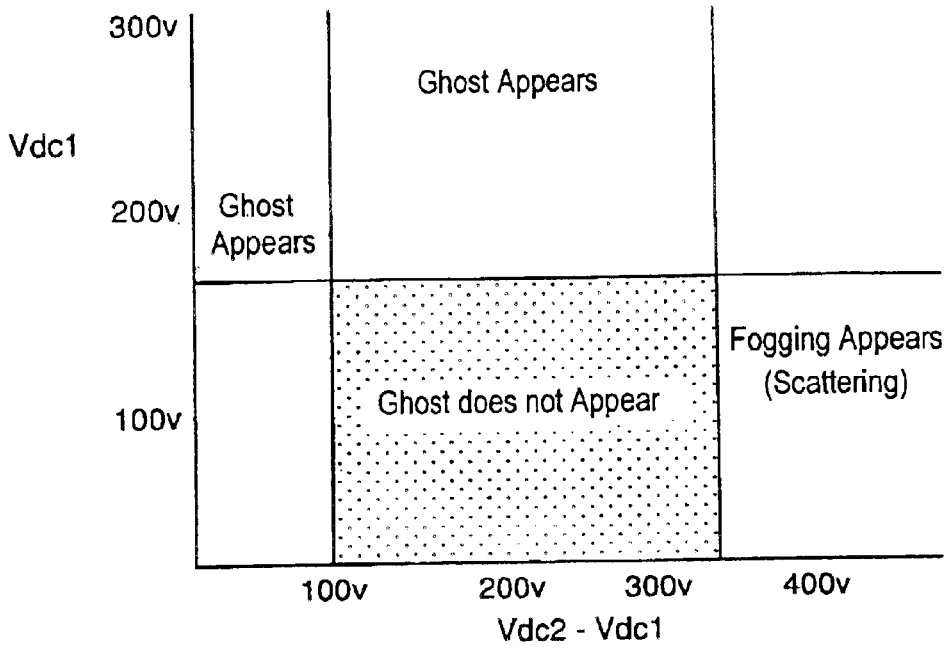
FIG. 3 is a graphical drawing illustrating an appropriate developing range of bias potential applied on a developing apparatus in an image forming apparatus according to the present invention.
Figure 4:
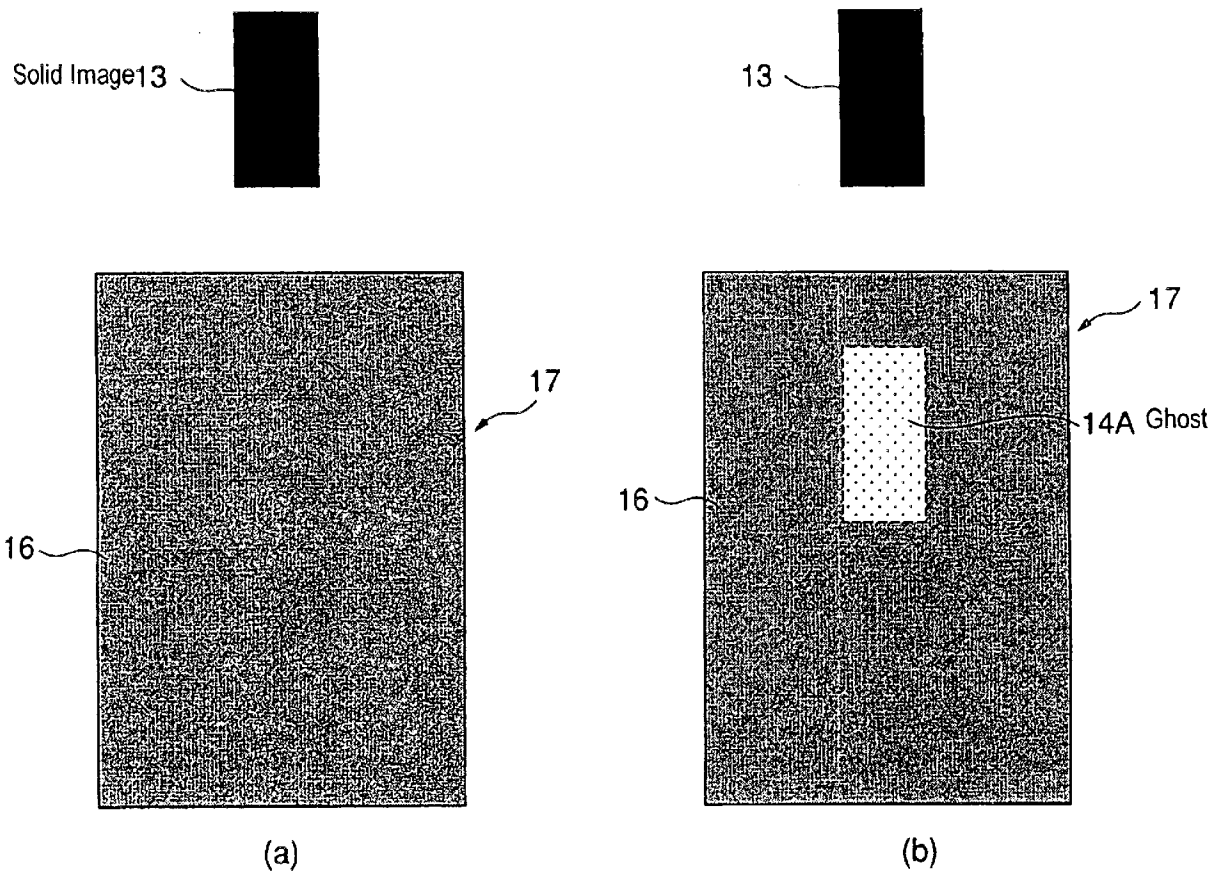
FIG. 4 is a schematic drawing illustrating the generation of a ghost on account of a containing ratio of high resistivity carrier to low resistivity carrier.
Figure 5:
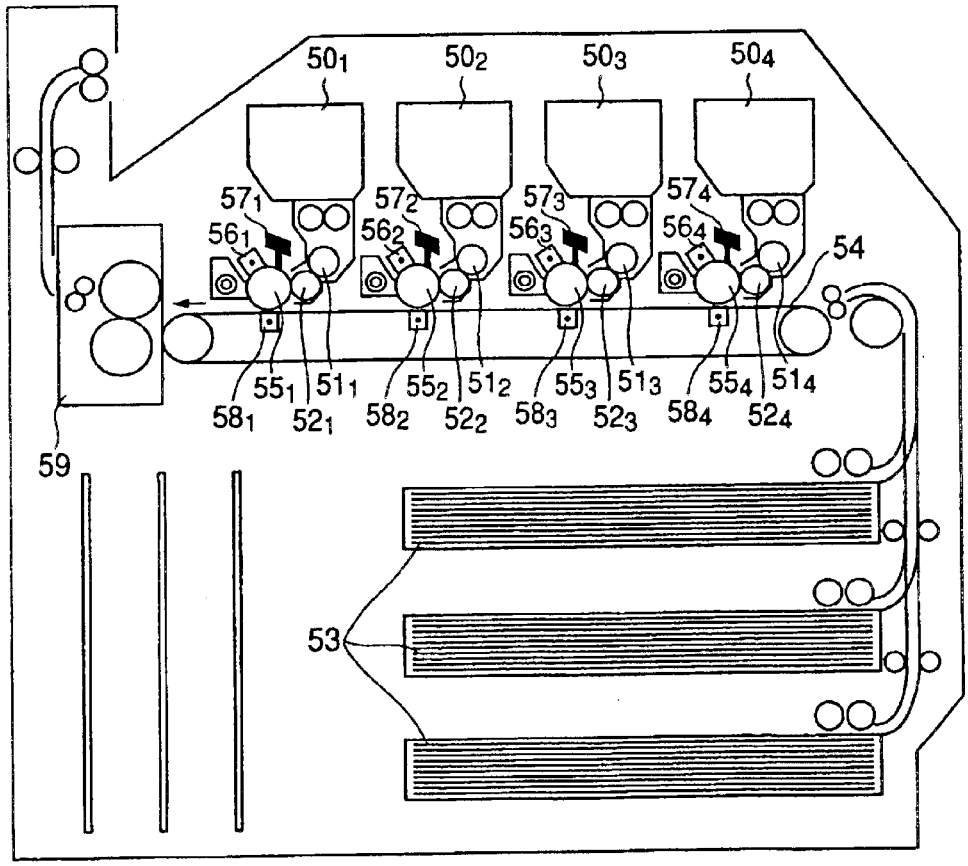
FIG. 5 is a schematic elevational drawing showing one embodiment of a tandem type image forming apparatus according to the present invention.
Figure 6:
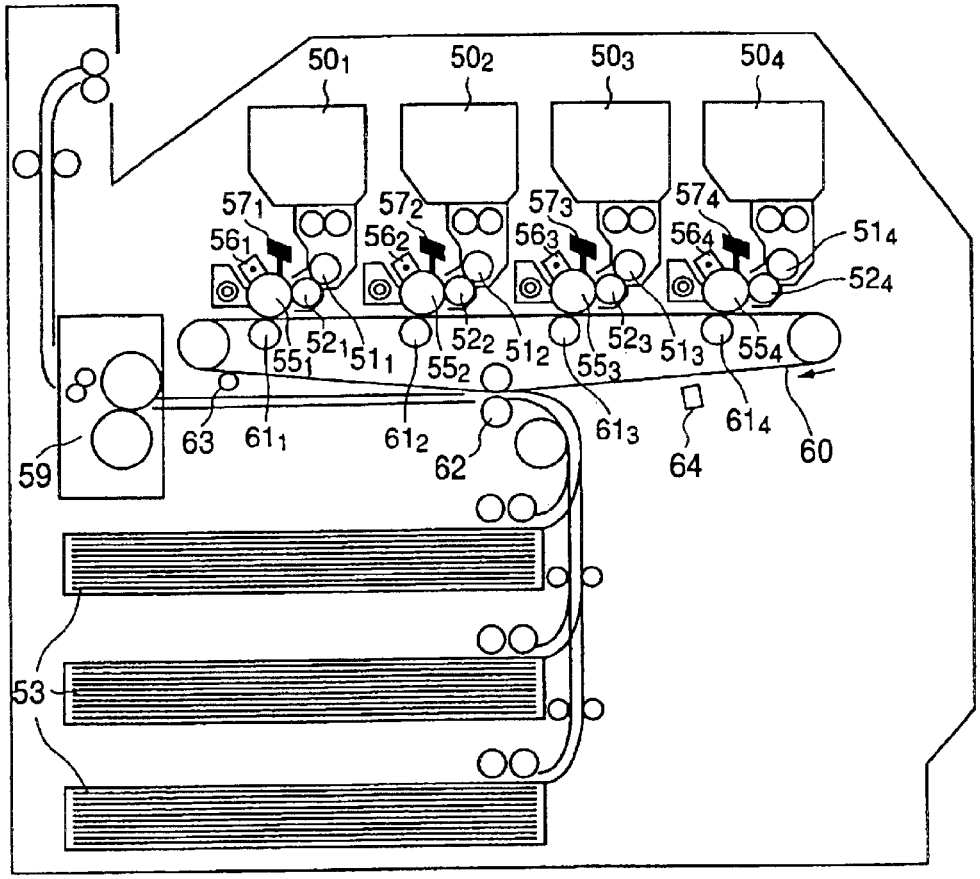
FIG. 6 is a schematic elevational drawing showing another embodiment of a tandem type image forming apparatus according to the present invention.

FIG. 1 is a schematic drawing illustrating a developing apparatus in a process unit used in a tandem type image forming apparatus according to the present invention. FIG. 2 is a sectional view showing a fundamental layer constructive model consisting of a-Si on an electrostatic latent image bearing body (photosensitive body) used in the present invention. FIG. 3 is a graphical drawing illustrating an appropriate developing range of bias potential applied on a developing apparatus in an image forming apparatus according to the present invention. FIG. 4 is a schematic drawing illustrating the generation of a ghost on account of a containing ratio of high resistivity carrier to low resistivity carrier. FIG. 5 and FIG. 6 show embodiments of tandem type image forming apparatuses in which a control method according to the present invention is executed. FIG. 5 shows a constructive embodiment of the case of transferring toner image formed on an electrostatic latent image bearing body (a photosensitive body) directly to a recording medium. FIG. 6 shows a constructive embodiment of the case of transferring toner image formed on an electrostatic latent image bearing body (a photosensitive body) to an intermediate transfer body at first and then to a recording medium.

In FIG. 1, 1 is a magnetic roll, which generates a magnetic brush 10 consisting of carrier 4. 2 is a developing roll having a toner thin layer 6 of toner 5 supplied from the magnetic brush 10, which develops an electrostatic latent image on an electrostatic latent image bearing body 3. 4 is carrier of toner. 4-1 is low resistivity carrier. 4-2 is high resistivity carrier. 5 is toner. 6 is a toner thin layer on the developing roll 2. 7 is a developing bias power source which applies a developing bias between the electrostatic latent image bearing body (the photosensitive body) 3 and the developing roll 2. 7*a* is a direct current bias ($V_{dc1}$) power source. 7*b* is an alternating current bias power source. 8 is a direct current bias ($V_{dc2}$) power source for the magnetic roll 1. 9 is a restricting blade, which restricts a thickness of the magnetic brush 10 on the magnetic roll 1.

In FIG. 2, 40 is base material; 41 is a barrier layer; 42 is a photosensitive layer consisting of a-Si; 43 is a surface protective layer. When expressed as the thickness of the a-Si electrostatic latent image bearing body (the photosensitive body) 3 hereinafter, the thickness means the distance from the surface of base material 40 of the electrostatic latent image bearing body (the photosensitive body) 3 to the outside surface of the outer layer on the electrostatic latent image bearing body (the photosensitive body) 3. Therefore, as shown in FIG. 2, in the case where the electrostatic latent image bearing body (the photosensitive body) 3 consists of the barrier layer 41, the photosensitive layer 42 and the surface protecting layer 43, the thickness of the photosensitive body 3 is the total thickness of these three layers.

In FIG. 5 and FIG. 6, 50 is a developer material container; 51 is a magnetic roll shown as 1 in FIG. 1; 52 is a developing roll shown as 2 in FIG. 1; 53 is a sheet supplying cassette containing recording media; 54 is a conveying belt for recording media; 55 is an electrostatic latent image bearing body (hereinafter referred to as a photosensitive body) similar to electrostatic latent image bearing body 3; 56 is an electric charging device for charging the photosensitive body; 57 is an exposing device for exposing an image to the photosensitive body; 58 is a transfer apparatus to apply a transfer bias for transferring a toner image on the photosensitive body 55 to a recording medium. 59 is a fixing apparatus for fixing a toner image transferred on the recording medium. In FIG. 6, 60 is an intermediate transfer body on which the toner image on each photosensitive body 55 is transferred to pile up; 61 is a transfer roller for transferring the toner image on the photosensitive body 55 to the intermediate transfer body 60; 62 is a secondary transfer roller for transferring the toner image on the intermediate transfer body 60 to the recording medium; 63 is a cleaner; 64 is a developing amount detecting means; A process unit comprises the photosensitive body 55, the developing roll 52, the magnetic roll 51, the electric charging device 56 and the exposing device 57.

In the first place, the action of these tandem type image forming apparatuses is explained. In a tandem type image forming apparatus having a method of transferring a toner image formed on the photosensitive body 55 shown in FIG. 5 directly to a recording medium, developer material consisting of toner corresponding to each color, such as yellow, cyan, magenta, and black, which is stored in the developer material container 50 ($\mathbf{50}_4$–$\mathbf{50}_1$) and carrier forms a magnetic brush on the magnetic roll 51 ($\mathbf{51}_4$–$\mathbf{51}_1$). The magnetic brush produces a toner thin layer on the developing roll 52 ($\mathbf{52}_4$–$\mathbf{52}_1$). When an unshown control circuit generates a signal of starting to print, a recording medium is delivered on a conveying belt 54 from a sheet supplying cassette 53, the photosensitive body is charged by the electric charging device 56 ($\mathbf{56}_4$–$\mathbf{56}_1$), and then exposed by the image signal sent to the exposing device 57 ($\mathbf{57}_4$–$\mathbf{57}_1$) to form a latent image which is developed with toner on the developing roll 52 ($\mathbf{52}_4$–$\mathbf{52}_1$), so as to meet the timing when the recording medium reaches each photosensitive body 55 ($\mathbf{55}_4$–$\mathbf{55}_1$) of each color. A transfer bias is applied by the transfer apparatus 58 ($\mathbf{58}_4$–$\mathbf{58}_1$) to transfer the toner image on the recording medium at the time when the recording medium reaches the photosensitive body. The same process is repeated on each photosensitive body $\mathbf{55}_4$–$\mathbf{55}_1$ so that each color image is successively transferred on the recording medium, fixed by the fixing apparatus 59 and the resultant recording medium is expelled.

In a tandem type image forming apparatus having a method of, after transferring a toner image formed on a photosensitive body 55 shown in FIG. 6, to an intermediate transfer body 60, transferring the toner image on the intermediate transfer body 60 to a recording medium, likewise the case shown in FIG. 5, developer material consisting of toner corresponding to each color, such as yellow, cyan, magenta, and black, which is stored in the developer material container 50 ($\mathbf{50}_1$–$\mathbf{50}_4$) and carrier forms a magnetic brush on the magnetic roll 51 ($\mathbf{51}_1$–$\mathbf{51}_4$). The magnetic brush produces a toner thin layer on the developing roll 52 ($\mathbf{52}_1$–$\mathbf{52}_2$). When an unshown control circuit generates a signal of starting to print, the photosensitive body is charged by the electric charging device 56 ($\mathbf{56}_4$–$\mathbf{56}_1$), and then exposed by the image signal sent to the exposing device 57 ($\mathbf{57}_1$–$\mathbf{57}_4$) to form a latent image which is developed with toner on the developing roll 52 ($\mathbf{52}_1$–$\mathbf{50}_4$), the toner image is transferred to the intermediate transfer body 60 by the transfer roller 61 ($\mathbf{61}_1$–$\mathbf{61}_4$) so as to pile up each toner image formed on each photosensitive body 55 ($\mathbf{55}_1$–$\mathbf{55}_4$) on the intermediate transfer body which comprises such as intermediate transfer belt. When all the toner images are transferred to the intermediate transfer body 60, the recording medium is delivered from the sheet-supplying cassette 53 to a secondary transfer position with the intermediate transfer body. A transfer bias is applied on the secondary transfer roller to transfer the toner image to the recording medium, which is fixed by the fixing apparatus 59 and expelled.

In a process unit of the tandem type image forming apparatus which is constructed as above according to the present invention, two component developer material consisting of toner 5 supplied to a magnetic roll 1 from an unshown developer material container, low resistivity carrier 4-1 and high resistivity carrier 4-2 forms a magnetic brush 10 where toner 5 is positively charged and the layer thickness is restricted by a restricting blade 9. The charged toner 5 is transferred to the developer roll 2 side by the potential difference between the magnetic roll 1 and the developing roll 2 to form a thin layer 6 of toner alone. Further, the toner 5 in the thin layer 6 flies to an electrostatic latent image formed on the electrostatic latent image bearing body (the photosensitive body) 3 by applying the bias of direct current bias 7*a* (Vdc1) added by alternating current bias 7*b* between the developing roll and the electrostatic latent image bearing body to develop. After development, residual toner 5 in the toner thin layer 6 on the developing roll 2 is recovered and exchanged with ease by contacting the magnetic brush 10 on the magnetic roll 1 to the toner thin layer 6 on the developing roll 2 with the brush effect of circumferential rotational speed difference alone without providing a specific apparatus such as a scraper blade.

The low resistivity carrier 4-1 recovers residual toner on the developing roll. In this embodiment, ferrite carrier having a volume resistivity of $10^4$ Ωm, the saturated magnetization of 70 mA $m^2$/g and the average particle size of 35 μm was used. Thus, in order to recover the residual toner from the developing roll, it is necessary to use carrier of resistivity $10^6$ Ωm or lower so as to tear off toner, which is stuck to the developing roll on account of the nip between the developing roll and the magnetic roll, with the magnetic brush. In order to enhance the tearing-off ability due to the electrode effect of the magnetic brush formed in the nip between the developing roll and magnetic roll, it is effective to set a saturated magnetization of low resistivity carrier at the magnetic force of 67 mA $m^2$/g or higher. When the saturated magnetization of the low resistivity carrier declines to less than 67 mA $m^2$/g, sufficient effect cannot be achieved since both the electrode effect at recovery and the scraping effect by the magnetic brush decrease. In order to increase contact points with toner, a carrier of particle size smaller than 40 micrometers (40 μm) is preferably used to increase the surface area of the carrier. Among low resistivity carriers of high magnetic force, there are magnetite carrier, Mn series ferrite and Mn—Mg series ferrite. Though these compounds can be used as carriers as they are, it is possible to use after modification of surface treatment within the extent that the resistivity does not increase.

High resistivity carrier 4-2 is negatively charged to hold positively charged toner 5. In the present embodiment, the surface of ferrite is coated with high molecular weight polyethylene together with a resistivity adjusting reagent so as to have highly abrasion resistant characteristic against such problems as toner sticking and coating tearing off. That is to say, coated carrier that endures until the developer's life comes to an end is used. Generally, when 20% or more of the surface coating of coated carrier has worn off, the ability to charge the toner properly is lost. In the case of the developing method in the present embodiment, contamination of image occurs by toner scattering at the electric charge of 5 μC/g or lower owing to insufficient charging; such as selective development is likely to occur at the electric charge of 20 μC/g or higher owing to decline of developing ability.

The high resistivity carrier 4-2 has a great significance in terms of application of charge to toner 5. It applies charge to toner 5 as well as effectuates prevention of scattering toner from the developing roll 2 when an alternating current is applied. Thus, it is inevitable to combine the high resistivity carrier 4-2 having charge ability with the low resistivity carrier because, though the low resistivity carrier 4-1 attached great importance to for use of recovery is effective for coping with the developing ghost, it is difficult to keep developing without fogging by giving an accurate charge to the toner 5 and further, toner 5 scatters from the surface of the developing roll 2 to bring about the malfunction of contaminating the charging device or the exposure unit when the print run is long.

As the high resistivity carrier 4-2, it is preferable to use a carrier for developing electrostatic latent images which can be prepared such that the surface of ferrite magnetic carrier having its saturated magnetization of 60–200 mA $m^2$/g is borne with a polymerization catalyst and is reacted with ethylene gas for polymerization to be coated with the film of high molecular weight polyethylene having an average molecular weight of 50 000 or greater wherein the coated amount of polyethylene is brought to 1–5% by weight and the resistivity of its surface is adjusted to $10^9$–$10^{12}$ Ωcm with electro-conductive particles. It is likely that carrier developing or image fogging occurs in case of the resistivity lower than $10^9$ Ωcm and image deterioration such as the decline of image depth occurs in case of the resistivity higher than $10^{12}$ Ωcm. The resisitivity is calculated from the measurement of the current flowing between electrodes of area of $5\times10^{-3}$ $m^2$ pressed on the upper and lower surface of a 5-mm-thick carrier layer with a load of 1 kg and with a voltage of 1–500 volts applied between the electrodes.

As the applicant of the present invention has disclosed in Japanese laid-open patent publication JP1998-142843, such a high resistivity carrier comprises a carrier core material having magnetism and a coated layer consisting of high molecular weight polyethylene resin which coats the surface of the carrier core material, the coated layer consisting of high molecular weight polyethylene resin containing a charge adjusting agent, a resistivity adjusting agent, a flow property adjusting agent and others, where durability and chargeability can be adjusted by setting various additives to the surface of high molecular weight polyethylene. As for high resistivity carrier, a carrier treated with a high resistivity treating material can be used in addition to the above-mentioned carriers if high durability is desired.

Regarding the mixing ratio of the high resistivity carrier 4-2 to the low resistivity carrier 4-1, the content of 50–80% of the low resistivity carrier in the carrier mixture 4 is appropriate in view of the recovery ability of residual toner on the developing roll and charge application to toner 5. Generation of a ghost image is recognized when the content is less than 50%; scattering of toner 5 cannot be prevented when the content is over 80%.

In the present embodiment, the mixing ratio of toner 5 is 2–40% by weight of toner in the total amount of carrier 4 and toner 5, preferably 3–30% by weight, more preferably 4–25% by weight. That is, when the mixing ratio of toner is under 2% by weight, insufficient image depth is achievable on account of excessive electrical charge; when over 40% by weight, toner scatters from the developing device on account of insufficient electrical charge, which results in contamination of the interior of the image forming apparatus or generation of toner fogging on the image.

By combining both carriers with the definite ratio, it is possible to recover toner 5 of the toner thin layer 6 on the developing roll while properly charged toner 5 is put into the developing roll 2 again. The electric charge on toner 5 is controlled to 5–20 $\mu$C/g so as to prevent toner scattering and image fogging; further, the latent image is developed at low potential so as to prevent developing hysteresis on the developing roll; as a result, an image forming apparatus having good recoverability of toner can be provided.

By setting the surface potential (charged potential) of the electrostatic latent image bearing body (photosensitive body) 3 to 250 volts or under and 100 volts or under after exposure, enough image depth can be attained while the potential applied on-the developing roll is kept low. A positively charged organic photosensitive body (OPC) is known heretofore as an electrostatic latent image bearing body (photosensitive body) 3 used in an image forming apparatus. In case the organic photosensitive body (OPC) is used as an electrostatic latent image bearing body (photosensitive body) 3, it is important to set the thickness of photosensitive layer to 25 micrometers or more and to increase the added amount of charge generating material in order to lower a residual potential to 100 volts or under. Particularly, an organic photosensitive body of monolayer structure is advantageous because charge-generating material can be added in the photosensitive layer.

Nevertheless, problem is the OPC is soft at the surface of the photosensitive layer so that the photosensitive layer is apt to be scraped by cleaning blade. Accordingly, a-Si photosensitive body having a thickness of the photosensitive layer more than 25 micrometers is lately used since durability and function maintaining characteristics (maintenance free) are excellent in comparison to the OPC photosensitive body. However, as a-Si photosensitive body is made to film by glow discharge decomposition method, it is disadvantageous in view of economy due to a long process time and a high production cost when the photosensitive layer is thick. Consequently, the present applicant have disclosed a-Si photosensitive body having a thickness of photosensitive layer less than 25 micrometers in Japanese laid-open patent publication JP1995-175276.

In case a-Si photosensitive body is used as a photosensitive material of the electrostatic latent image bearing body (photosensitive body) 3, though the surface potential after exposure is characteristically very low at below 10 volts, the dielectric strength lowers due to lowering of the saturated charge potential if the film becomes too thin. Meanwhile, a surface charge density on the electrostatic latent image bearing body (photosensitive body) 3 at the image formation is improved to be likely to improve a developing ability. These characteristics are particularly conspicuous in case of the thickness under 25 micrometers, more favorably under 20 micrometers if a-Si photosensitive body having a high dielectric constant of about 10 is used.

When the thickness of photosensitive layer 42 comes to under 10 micrometers, however, it becomes difficult to adjust the potential on the electrostatic latent image bearing body (photosensitive body) 3. As a result, so called black points and fogging tends to appear easily. If the thickness of the photosensitive layer 42 reduces to less than 10 micrometers, the saturated charge potential lowers to tend to be unable to assure a necessary charge potential. Meanwhile, the thickness of the photosensitive layer exceeds 25 micrometers, it is difficult to exert low potential phenomenon so that ozone generates easily, or a production time of the photosensitive layer is prolonged, which is disadvantageous in view of economy. Furthermore, for the time over which a positive hole born in the charge generating layer of the photosensitive layer 42 moves to the surface of the photosensitive layer is prolonged, it becomes difficult to adjust the potential of electrostatic latent image bearing body (photosensitive body) 3, which results in the problem of generating fogging or decline of image depth. It is preferable to set the thickness of the photosensitive layer 42 on the electrostatic latent image bearing body (photosensitive body) 3 to the range of 11–25 micrometers and more preferable to the range of 12–18 micrometers.

Further, as a more preferable state of the photosensitive layer, a thickness of the surface protective layer 43 is preferably more than 3 micrometers and less than 5 micrometers. That is, if a thickness of the surface protective layer 43 is less than 0.3 micrometers, the characteristics such as saturated charge potential, abrasion resistance and environmental durability of the photosensitive layer 42 tend to decline. Meanwhile, if the thickness of the surface protective layer 43 is more than 5 micrometers, it becomes a cause of image deterioration and is unprofitable because of a prolonged production time. Thus, it is more preferable for the thickness of the surface protective layer 42 to be in the range of 0.3–3 micrometers in view of the excellent balance of a production time and a saturated charge potential of photosensitive layer 42.

Though a material consisting of the photosensitive layer is not necessarily restricted as far as it is amorphous silicon, as preferable materials, inorganic materials such as a-Si, a-SiC, a-SiO and a-SiON can be cited. As for surface protective layer 43, a-Si has particularly high resistivity and gives more excellent saturated charge potential, abrasion resistance and environmental resistance so that it is suitable for the present embodiment. An a-SiC having a specific ratio of Si to C is preferable; a-$Si_{(1-X)}C_x$($0.3 \leqq X \leqq 1.0$) can be cited as such an a-SiC, and more preferably a-$Si_{(1-X)}C_x$ ($0.5 \leqq X \leqq 0.95$). The reason for this is because such an a-SiC has a particularly high resistivity, in the range $10^{10}$–$10^{11}$ Ωm and gives excellent saturated charge potential, abrasion resistance and environmental resistance (humidity resistance).

As for a bias between the developing roll 2 and electrostatic latent image bearing body (photosensitive body) 3, though it is decided by a direct current bias source 7*a* ($V_{dc1}$)and alternating current bias source 7*b*, a potential of bias 8 ($V_{dc2}$) is preferably less than 500 volts. If over 150 volts is applied by the direct current bias source 7*a* ($V_{dc1}$), it becomes difficult to recover toner by magnetic brush as an electrostatic force of toner sticking to developing roll 2 is increased. By applying the alternating current electric field, an image on the electrostatic latent image bearing body (photosensitive body) is accurately developed and residual toner on the developing roll is easily recovered.

FIG. 3 shows the range of appropriate developing direct current bias potential 7*a* ($V_{dc1}$) and 8 ($V_{dc2}$), which does not bring about developing ghost or fogging in the developing unit of the present embodiment. The horizontal axis denotes a potential difference $|V_{dc2}-V_{dc1}|$; the vertical axis denotes bias potential $V_{dc1}$. As shown in FIG. 3, ghost appears when the bias potential $V_{dc1}$ is higher than 150 volts and also ghost appears when the bias potential $V_{dc1}$ is lower than 100 volts. Hence, if the direct current bias potential 7*a* ($V_{dc1}$) of the developing roll is lower than 150 volts and the potential difference $|V_{dc2}-V_{dc1}|$ between the direct current bias potential 8 ($V_{dc2}$) of the magnetic roll 1 and the direct current bias potential 7*a* ($V_{dc1}$) of the developing roll 2 is in the range of 100–350 volts, high quality image is found to be obtained. As for the alternating current (AC) bias source 7*b*, it is preferable to set the peak-to-peak voltage $V_{pp}$ to a range of 500–2000 volts and the frequency to a range of 1–3 kHz.

Thus, by setting the developing bias low, the insulation breakdown of a-Si thin film on the electrostatic latent image bearing body (photosensitive body) 3 is prevented and at the same time, over-charging of the toner is avoided, which is effective for suppressing the hysteresis of developing. The toner thin layer 6 of 10–100 micrometers, more preferably 30–70 micrometers is formed on the developing roll, the gap between the developing roll and electrostatic latent image bearing body (photosensitive body) 3 is within the range of 150–400 micrometers, more preferably within the range of 200–300 micrometers and the direct and alternating current electric field causes toner to jump across to the electrostatic latent image bearing body (photosensitive body) 3 to be able to obtain a clear image.

The gap between the restricting blade 9 and magnetic roll 2 is 0.3–1.5 mm and the gap between the magnetic roll 1 and developing roll 2 is also about 0.3–1.5 mm. By disposing this way, the toner thin layer 6 on the developing roll is set to the thickness of 10–100 micrometers, more preferably to the thickness of 30–70 micrometers. The thickness corresponds to the value of 5 to 10 toner layers in case the average diameter of toner 5 is 7 micrometers. The gap between the developing roll and the electrostatic latent image bearing body (photosensitive body) 3 is 150–400 micrometers, more preferably 200–300 micrometers. If narrower than 150 micrometers, fogging occurs; if broader than 400 micrometers, it is difficult to cause the toner 5 to jump across to the electrostatic latent image bearing body (photosensitive body) 3 to obtain enough image depth; and that becomes the reason for generating a selective development.

According to the present embodiment, when a plurality of images of the process units are successively formed, in an image-non-forming period, that is a time period from the time one image has developed until the time the successive developing begins or before the beginning of an image forming, an equal potential state between the developing roll and the magnetic roll is generated as rotating the both rolls to recover residual toner of the toner thin layer 6 on the developing roll 2 by the magnetic brush 10 at the state thereof.

The image-non-forming period may be detected, for instance, based on the printed image data delivered to the exposing device 57 or the front end or back end of the recording medium in the sheet supplying cassette 53.

The electrostatic latent image bearing body (photosensitive body) 3 was made of a-Si having the layer thickness of 15 micrometers and the surface potential of 230 volts was applied to the body. The direct current bias 7*a* $V_{dc1}$) of 50 volts plus the alternating current bias of 1.1 kV at the peak-to-peak potential ($V_{pp}$) and frequency of 3.0 kHz was applied to the developing roll 2. The direct current bias 8 ($V_{dc2}$) of 200 volts was applied to the magnetic roll. An equal potential state was generated by getting both of the surface potential of the developing roll (i.e. the direct current bias 7*a* ($V_{dc1}$)) and the surface potential of the magnetic roll (i.e. the direct current bias 8 ($V_{dc2}$)) zero at the image-non-forming period. Estimation was made whether a ghost image of black solid image appeared or not by forming a set of images of an image pattern arranged such that a solid image consisting of a rectangular solid black and a half tone image broader than the solid image were successively developed. The image depth of the half tone image was 25% that of the solid image so that a ghost image appeared more readily.

As comparative examples, tests were done on the condition that the surface potential of the magnetic roll was not equal to that of the developing roll even at the image-non-forming period. In the comparative example 1, the same extent of bias as at the image forming period was applied at the image-non-forming period; i.e., the direct current bias 7*a* ($V_{dc1}$) of 50 volts plus the alternating current bias 7*b* of 1.1 kV at the peak-to-peak potential $V_{pp}$ and of 3.0 kHz frequency was applied to the developing roll 2 and the direct current bias 8 ($V_{dc2}$) of 200 volts was applied to the magnetic roll. In the comparative example 2, the bias on the developing roll 2 was exchanged to that on the magnetic roll 1 at the image-non-forming period; i.e., the direct current bias 7*a* ($V_{dc1}$) of 200 volts without the alternating current bias 7*b* was applied to the developing roll 2 and the direct current bias 8 ($V_{dc2}$) of 50 volts was applied to the magnetic roll. Experiments were performed, and the results of observation were collected with regard to the image depth, the ghost and the fogging of 3 points of successive printing, i.e., at initial state, after 100 sheets printing and after 1000 sheets printings. The results were shown in Table 1.

TABLE 1

| | At initial state | | | After 100 sheets printing | | | After 1000 sheets printing | | |
|---|---|---|---|---|---|---|---|---|---|
| | depth | ghost | fogging | depth | ghost | fogging | depth | ghost | fogging |
| Example | ○ | ○ | ○ | ○ | ○ | ○ | ○ | ○ | ○ |
| Comparative example 1 | ○ | ○ | ○ | ○ | Δ | ○ | Δ | X | ○ |

In the table 1, ○ in the depth column denotes that a formed image had no scratchy pattern, Δ in the depth column denotes that a formed image had a little scratchy patterns. ○ in the ghost and fogging column denotes that a half tone image had no ghost or fogging image as shown in FIG. 4(*a*) when an image pattern shown in FIG. 4 was printed. Δ in the ghost and fogging column denotes that a half tone image had a little ghost or fogging image as shown in FIG. 4(*b*). x in the ghost and fogging column denotes that a ghost or fogging image was clearly observed in the half tone image.

It is understood from Table 1 that, in the example, excellent images which had no scratchy pattern, no ghost or fogging image were formed at any state of the initial state, after 100 sheets printing and after 1000 sheets printing. In comparison to the example, since the same bias as at the image forming period was applied at the image-non-forming period in comparative example 1, ghost had been gradually accumulated to be observed a little at the point after 100 sheets printing and finally to be observed clearly at the point after 1000 sheets printing. In comparative example 2, though generation of ghost was prevented since the bias on the developing roll 2 was exchanged to that on the magnetic roll 1 at the image-non-forming period, toner charge varied to generate fogging images to be recognized a little at the point after 100 sheets printing and to be recognized apparently at the point after 1000 sheets printing. As a result of Table 1, it is understood that a clear image can be formed while making an equal potential state at the image-non-forming period prevents a generation of fogging and ghost.

The above embodiment is explained the example of an equal potential state at the image-non-forming period on the successive forming of a plurality of images. The case is also applicable to an equal potential state at the image-non-forming period before the beginning of image forming. Though the equal potential of developing roll 2 and the magnetic roll 1 was set to zero, it is also applicable if their surface potentials are equal each other, e.g. the potential of both rolls is 50 volts. Controlling the surface potentials of the developing roll 2 and magnetic roll 1 can also actualize the equal potential state. Further, it is not necessary to be equal potential state for whole span of the image-non-forming period but it is applicable if an equal potential state is actualized for a part of the image-non-forming period.

Toner developing amount varies due to increasing charge of toner in case of successive printing of extreme low printing ratio images or in case of printing of images having only one specific color. In the present embodiment, deteriorated toner is expelled before the image deteriorates to obtain a stable color image at all times.

That is, a manuscript density on each image is evaluated by measuring an image data as a dot number by an unshown CPU of the tandem type image forming apparatus and when an average manuscript density A of manuscript density a1, a2, a3, . . . , of each measured sheet comes to less than 3%, an image forming process is interrupted to bring to an image-non-forming state and a refresh process is performed, that applies an alternating current electric field to the developing roll 2 so as to cause toner on the developing roll 2 to jump to the side of the photosensitive body 3. Though, in the present embodiment, the case in which the image forming process was immediately interrupted was explained, a refresh process may be performed after a successive printing.

The developing roll 2 has a surface treated by blasting with indefinite or definite shaped particles. The alternating current electric field is a potential of direct current voltage plus an alternating current component of a rectangular wave, a triangular wave or sinusoidal wave. An image printing density is calculated by each print or an average printing ratio of a definite printing sheets (e.g. 1–500 sheets) is calculated. Toner is consumed by causing toner to jump from the developing roll corresponding to the printing density at the time when image is not formed on the photosensitive body (i.e. image-non-forming period) or after the photosensitive body and the developing roll cease turning. Toner attached to the photosensitive body 3 at the image-non-forming period by the refresh process is expelled to the recording medium from photosensitive body 3 in case of the tandem type image forming apparatus not using an intermediate transfer body shown in FIG. 5 and to the intermediate transfer body 60 in case of the tandem type image forming apparatus using a intermediate transfer body shown in FIG. 6.

Thus, the alternating current bias is controlled so as to consume toner when the photosensitive body 3 and developing roll 2 are at the operating condition after calculating the average printing ratio. And it was experimentally observed that toner charge up occurred readily when an average printing ratio was 3% or under. When the average printing ratio decreases, residual toner amount of the developing roll increase. Hence, it is necessary to increase the amount of toner jumping to the photosensitive body drum by rotating plural rounds of the developing roll and prolonging the applied time of the alternating current bias to tear off the residual toner. It is desirable to provide a several kinds of refresh modes in order to cope with any states (such as environmental conditions), although toner consuming amount at the image-non-forming part is at least 3% of that in the manuscript printing period. At the refresh process, the effective value of alternating current electric field for refresh is greater than that at the image forming period so as to easily consume toner.

In the case of the aforementioned refresh process, toner transferred to the intermediate transfer body 60 is detected by a developing amount detecting means 64 that a definite amount of each color is developed and toner deteriorating state can be detected at the same time by measuring developing amount of forcibly consumed toner. When toner is transferred to the intermediate transfer body 60 to refresh, toner is transferred such that colors are piled up at the place of the intermediate transfer body where a recording sheet does not contact so as to perform rapidly the refresh in case there are a plurality of process units which do not satisfy prescribed developing amount.

Toner developing amount varies owing to increase of toner's charge in case of successive printing of extreme low printing ratio images or in case of printing of images having only specific color as mentioned above. As toner sticks tightly to the surface of carrier 4 by electrostatic force when a toner charge (hereinafter referred to as Q/M) increases, the output value of permeability of the developer material by a toner concentration (T/C) sensor disclosed in detail in Japanese laid-open patent publication JP2000-112220 and JP2000-112221 decreases and the permeability increases since toner tends to be peeled off to float from the surface of carrier as Q/M decreases.

Figure 7:
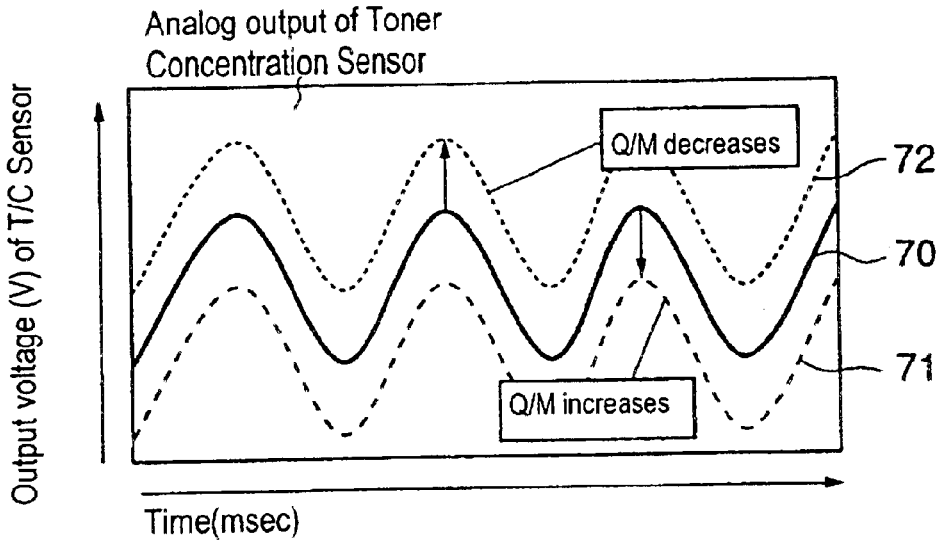
FIG. 7 is a graph showing the effect of toner charge (Q/M) on the output value of a permeability sensor.

A permeability sensor for measuring toner concentration disclosed in Japanese laid-open patent publication JP2000-An image forming apparatus of non-contact developing method using two-component developer material which is capable of obtaining a clear image free from fogging, ghost and toner contamination. The image forming apparatus has at least one developing unit which includes a developing roll and a magnetic roll, the developing unit develops an electrostatic latent image on a photosensitive body with a toner thin layer formed on the surface of a developing roll wherein a toner thin layer forming region on the developing roll is smaller than a magnetic brush forming region on the magnetic roll. A high resistivity region is adjacent each end of the toner thin layer forming region on the developing roll. A control device controls a developer material replenishment and controls the biasing to the developing roll and magnetic roll. 112220 and JP2000-112221 is disposed under a screw type stirrer having a screw fixed to a rotating shaft which is rotatably supported in a developer material container or under a stirrer (a simple harmonic motion type stirrer) having a lot of blades inclined parallel in the axial direction fixed to a similar rotating shaft. Since the developer material on the permeability sensor varies as the stirrer rotates, the out put voltage of the T/C sensor pulsates as shown in FIG.7 70. As the Q/M of toner increases, toner sticks tightly to the surface of carrier 4 by electrostatic force as mentioned above so that the permeability detected by the permeability sensor decreases. The permeability increases as shown in FIG. 7 72 since toner is peeled off the surface of the carrier to easily float as Q/M decreases.

Nevertheless, as explained above, in a hybrid development, since toner bias is continued to be applied while being rubbed by the magnetic brush 10, the toner Q/M of the toner thin layer on the developing roll tends to increase. Toner replenishment is performed when the toner concentration decreases as the value of the toner concentration sensor increases. However, there is a case, where toner is not replenished since the toner concentration (T/C) is estimated higher than actual value because of low indicated value of permeability as the Q/M increases in spite of continued consumption of toner by printing.

Accordingly, in the present embodiment, as described above, a printing rate was read by measuring as a dot number by an unshown CPU of the tandem type image forming apparatus and the consumed amount of toner was estimated by calculation. When the estimated value was lower than the actual toner concentration, the refresh process was executed so as to expel toner.

ΔT is defined as in the following equation, where $T_{ave}$ (which increases by increasing Q/M ) is an average value of output values among mixer periods and $T_{ini}$ is a initial value, $$\Delta T = T_{ini} - T_{ave}. \quad (1)$$

The consumed toner D to the total carrier amount in developer material is expressed as follows, where C is the estimated value of consumed toner at prescribed number of sheets by calculation with measured dot numbers, $$D = C/(\text{total carrier amount in developer material}) \times 100(\%). \quad (2)$$

when D>1 (%), and in case (i) $\Delta T \geqq 0.2$ V, a potential applied to developing roll 2 is equal to the potential applied to the magnetic roll 1 and a mode is set to expel toner actively to the intermediate transfer body, for example, by developing a solid image onto the photosensitive body; and in case (ii) $0\ V < \Delta T < 0.2$ V, a mode is set to expel toner a little, for example, by developing a half tone image or a line image onto the photosensitive body; and in case (iii) $\Delta T \leqq 0$ V, a mode is set to exchange the toner container as toner is deteriorated.

In this control, a number of dots are counted by the CPU (not shown) in the tandem type image forming apparatus when a toner replenishing motor stops to rotate; when the toner replenishing motor rotates to replenish toner, the toner concentration sensor (the permeability sensor) sensed the replenishment to reset the value of $T_{ini}$, C and D and to repeat the same after that.

Figure 8:
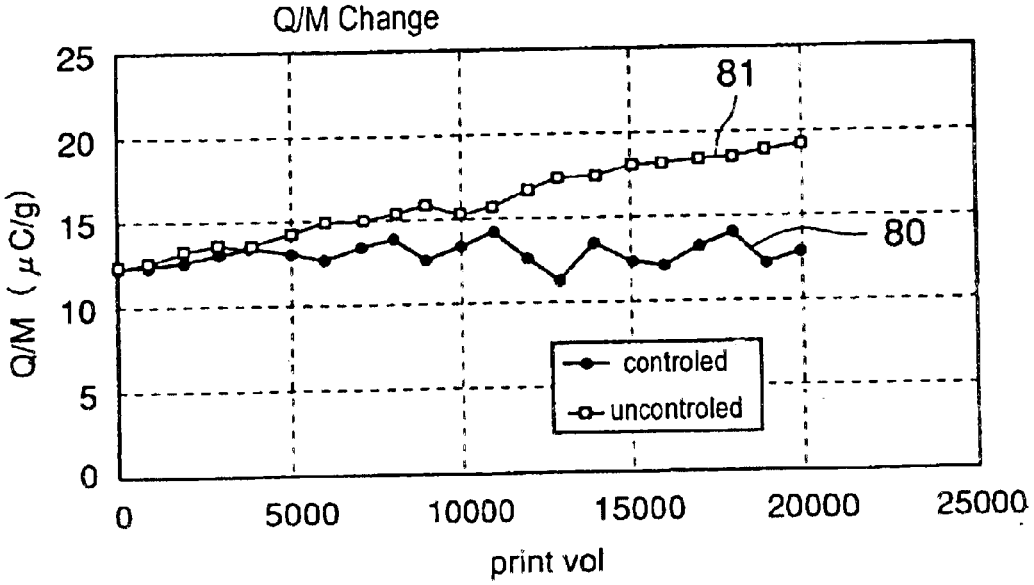
FIG. 8 is a graph showing toner charge (Q/M) difference between the case of developing control based on the present invention and the case without developing control.

By controlling Q/M in this way, a remarkable difference was observed with Q/M change. Thus, as shown in FIG. 8, 80 is a Q/M change with control as described above and 81 is a Q/M change without control where x-axis denotes a number of sheets and y-axis denotes Q/M (μC/g). As a result, though the Q/M increases without control, the Q/M falls apparently in a narrow range. Therefore, according to the present embodiment, since the magnetic brush formed on the magnetic roll recovers all toner on the developing roll by equalizing the potential of both rolls as rotating the developing roll and the magnetic roll at the image non forming period or before beginning of forming images so as to cancel the developing hysteresis on the developing roll and to prevent generation of ghost and fogging, charged toner is properly supplied to the developing roll, a stable image quality for a long time can be obtained and the process unit can be constructed compactly as well so that the tandem image forming apparatus itself can be of compact construction.

Further, according to the present embodiment, when images having extreme low printing rate are successively printed or images having only restricted color are printed, the failure that toner replenishment stops by estimating toner consumption greater than actual value on account of decreasing permeability output value detected by the toner concentration (T/C) sensor as toner adhere tightly to the surface of carrier due to increasing Q/M is prevented so as to be able to obtain stable image quality and construct process unit compactly, whereby the tandem image forming apparatus itself can be constructed compactly.

And further, according to the present embodiment, while expelled toner amount can be always found, this control can be made in short time even though toner is expelled from a plurality of process units.

According to such embodiment, generation of ghost images at successive developing is prevented without complicating the developing unit; properly charged toner is supplied to the developing roll whereby stable image quality is obtained for long time while a compact process unit can be constructed. Even though images having extreme low printing rate are printed successively or images having only restrictive color are printed, variation of toner amount due to increasing charge of developer material is prevented and deteriorated toner is expelled from the process unit before images change, whereby stable color images can always be obtained.

FIG. 3 shows the range of the direct current bias potential 7*a* ($V_{dc1}$) of the developing roll 2 and the direct current bias potential 8 ($V_{dc2}$) of the magnetic roll, which give excellent condition where no developing ghost and no fogging appears. The horizontal axis denotes a potential difference $|V_{dc2}-V_{dc1}|$, the vertical axis denotes a bias potential $V_{dc1}$ of the developing roll. As understood from FIG. 3, ghosts appear when the bias potential $V_{dc1}$ is higher than 150 V and when the potential difference $|V_{dc2}-V_{dc1}|$ is less than 100 V. In addition, when the potential difference is greater than 350 V, then toner scatters to generate fogging. Accordingly, high quality images are found to be obtained as far as the potentials fall in the following range. That is, the direct current bias potential 7*a* ($V_{dc1}$) is lower than 150 V; the potential difference $|V_{dc2}-V_{dc1}|$ of the direct current bias potential 8 ($V_{dc2}$) of the magnetic roll 1 and the direct current bias potential 7*a* ($V_{dc1}$) of the developing roll 2 is within the range of 100–350 V. Regarding the potential of the alternating current bias source 7*b* applied to the developing roll 2, it is preferable to apply a potential of rectangular wave having a peak-to-peak voltage $V_{p-p}$ of 500–2000 V, a frequency of 2–4 kHz and a positive or negative duty ratio of less than 45% for positively or negatively charged toner respectively. Thus, to set the developing bias low is effective for suppressing a high voltage break down of a-Si thin film on the photosensitive body 3 while preventing excessive charge of toner 5 and hysteresis of development.

Two component developer material forms magnetic brush 10 on the magnetic roll 1 consisting of carrier 4 and toner 5, which is charged by stirring. The carrier 4 consists of ferrite particles surface of which is coated with high molecular weight polyethylene and treated with resistivity adjusting agent so as to have strong surface property which copes with such problem as a toner adhering and coat peeling whereby coating material does not peel off until the life of a developer comes to an end. Generally speaking, if more than 20% of the coating material on the surface of surface coated carrier is peeled off, charging property to toner changes. In case of the developing method of the present embodiment, image contamination due to scattering of insufficiently charged toner or deterioration of developing property is observed and what is called selective developing is generated. Therefore, it is important to ensure the durability of the carrier. As mentioned above, the carrier whose surface resistance is adjusted by putting a high molecular weight polyethylene coating on the surface of ferrite, which is polymerized with the method to produce durable coated polymer for whole life of developer is used.

In such constructed developing apparatus of the image forming apparatus according to the present embodiment, two component developer material consisting of toner 5 and carrier 4 is supplied from an unshown developer material container to the magnetic roll 1. The developer material positively charges toner 5 by stirring and forms magnetic brush 10 whose layer thickness is restricted by restricting blade 9. The charged toner 5 is transferred with the potential difference $|V_{dc2}-V_{dc1}|$ between the magnetic roll 1 and the developing roll 2 to form a toner thin layer 6 on the developing roll 2. Toner of the toner thin layer 6 jumps across to develop the electrostatic latent image on the electrostatic latent image bearing body (photosensitive body) 3 with the bias of direct current bias 7*a* ($V_{dc1}$) plus alternating current bias 7*b* having rectangular waves applied between the developing roll 2 and the electrostatic latent image bearing body (photosensitive body).

In the present embodiment, an equal potential state between two rolls is generated by rotating the developing roll 2 and the magnetic roll 1 at an image non-forming period such as a period before and after forming image and alternating current electric field having rectangular wave is generated. Toner of the toner thin layer 6 remained on the developing roll after developing is replaced with the magnetic brush and the alternating current bias by contacting the magnetic brush 10 on the magnetic roll 1 to the toner thin layer on the developing roll 2. Thus, toner recovery and replacement are easily done with the brush effect born from the difference of circumferential speeds of both rolls without broadening or varying a charge distribution of toner and without a special device such as a scraper blade.

An image-non-forming period contains such as a period of start up of the apparatus when the developing roll does not develop apart from the above-mentioned periods. An image-non-forming period may be detected on the basis of a printed image data transmitted to a disposing device which disposes an image to the electrostatic latent image bearing body (photosensitive body) 3 or by the front end or back end of a recording medium in the sheet supplying cassette containing recording media. Further in the present embodiment, the length between recording media is controlled longer than the process circumference length on the developing roll 2 in order to replace all of toner on the developing roll 2 within the image-non-forming period such as a period between recording media at successive image forming. Further in the present embodiment, the rotational speed of the magnetic roll 1 is at least as fast as the rotational speed of the developing roll 2.

Toner on the developing roll 2 is recovered and replaced in such manner as described above. If toner has not replaced sufficiently, as shown in FIG. 4(*b*), the part corresponding to the solid image 13 cannot be developed at the next development of the electrostatic latent image bearing body, which results in generation of a ghost 44 on a half tone image 16. Thus, if the rectangular solid black image 13 and the half tone image 16 broader than the solid image are disposed such that both images are developed successively, as shown in FIG. 4(*b*), the part corresponding to the solid image, which has been developed before, the ghost 14A remains.

In the process unit of the present embodiment constructed in this manner, as shown in Table 2, the images formed with the test apparatus of a 12 sheets apparatus were observed and estimated with various biases at the image-non-forming period of a period between the recording media by varying a surface potential (i.e. a direct current bias 7*a* ($V_{dc1}$) and an alternating current potential source 7*b* of the developing roll 2 and a surface potential (i.e. a direct current 8 ($V_{dc2}$)) of the magnetic roll 1. The estimation was made by observing the image depth, whether a ghost 14A of the black solid image appeared or not and a state of fogging by forming image in a manner that the rectangular solid black image 13 and the half tone image 16 broader than the solid image were disposed such that both the images were developed successively, as shown in FIG. 4(*b*), the result of which is arranged in Table 2; and the state of generating toner sticking to the developing roll 2 was further observed by printing a white image, the result of which is arranged in Table 3. The developing roll 2 in the test apparatus of a 12 sheets apparatus has a diameter of 16 mm and a circumferential length of 50.24 mm; and since the space between recording media that corresponds to the image-non-forming period is 51 mm, toner on one circumference of the developing roll can be replaced between the sheets.

As for the condition of this evaluation, the surface potential of 250V was applied to the electrostatic latent image bearing body (photosensitive body) using a-Si having a film thickness of 14 μm, the direct current bias 7*a* ($V_{dc1}$) of 50V and the alternating current bias of 1.3 kV as a peak-to-peak voltage $V_{pp}$, the frequency of 3.0 kHz and the duty ratio of 50%. The direct current bias 8 $V_{dc2}$ of 200V was applied to the magnetic roll 1, the magnetic roll 1 was rotated at a circumferential speed twice as fast as the developing roll. As examples 1–3, an equal state of potentials was generated by setting the surface potential of the developing roll 2 (i.e. the direct current bias 7*a* ($V_{dc1}$)) and the surface potential of the magnetic roll 1 (i.e. direct current bias 8 ($V_{dc2}$)) to zero V, while alternating current fields having a peak-to-peak voltage of 1.3 kV, three variations of duty ratios of 40%, 45% and 50% and a rectangular wave were applied. As a comparative example 1, the surface potential of the developing roll 2 (i.e. the direct current bias 7*a* ($V_{dc1}$)) is set to 50 V without an alternating current bias. As a comparative example 2, the surface potential of the developing roll 2 (i.e. the direct current bias 7*a* ($V_{dc1}$)) is set to 200 V without an alternating current bias.

TABLE 2

| | Photosensitive body | Surface potential | V1 Developing roll | V2 Magnetic roll | Circumferential speed difference | Potential between sheets |
|---|---|---|---|---|---|---|
| Example 1 | a-Si<br>14 μm | 250 V | Vdc1: 200 V<br>Vpp: 1.3 kV<br>Duty: 50%<br>f: 3 kHz | Vdc2: 200 V | Speed of magnetic roll is 2 times the speed of developing roll | Vdc1 = Vdc2 = 0 V<br>Vpp: 1.3 kV<br>Duty: 50% |
| Example 2 | b- Si<br>14 μm | 250 V | Vdc1: 200 V<br>Vpp: 1.3 kV<br>Duty: 50%<br>f: 3 kHz | Vdc2: 200 V | Speed of magnetic roll is 2 times the speed of developing roll | Vdc1 = Vdc2 = 0 V<br>Vpp: 1.3 kV<br>Duty: 45% |
| Example 3 | c-Si<br>14 μm | 250 V | Vdc1: 200 V<br>Vpp: 1.3 kV<br>Duty: 50%<br>f: 3 kHz | Vdc2: 200 V | Speed of magnetic roll is 2 times the speed of developing roll | Vdc1 = Vdc2 = 0 V<br>Vpp: 1.3 kV<br>Duty: 40% |
| Comparative example 1 | d-Si<br>14 μm | 250 V | Vdc1: 200 V<br>Vpp: 1.3 kV<br>Duty: 50%<br>f: 3 kHz | Vdc2: 200 V | Speed of magnetic roll is 2 times the speed of developing roll | Vdc1 = 50 V<br>Vdc2 = 0 V<br>Vpp: not applied |
| Comparative example 2 | e-Si<br>14 μm | 250 V | Vdc1: 200 V<br>Vpp: 1.3 kV<br>Duty: 50%<br>f: 3 kHz | Vdc2: 200 V | Speed of magnetic roll is 2 times the speed of developing roll | Vdc1 = 200 V<br>Vdc2 = 0 V<br>Vpp: not applied |

As for estimation of the depth, ghost and fogging as shown in Table 3, the generation of the depth, ghost and fogging were observed at three points of the initial state, after 100 sheets printing and after 1000 sheets printings. In the Table 3, a mark ○ in the depth column shows that scratchy image was not observed and Δ shows that scratchy image was observed a little. As for marks ○,Δ,x in the ghost and fogging column, when an image pattern shown in FIG. 4 is printed, a mark ○ is put in case a ghost or a fogging is not observed at all on the half tone image as in 4(*a*), a mark Δ is put in case a ghost or a fogging is observed a little on the half tone image as in 4(*b*) and a mark x is put in case a ghost or a fogging is observed apparently.

TABLE 3

| | Initial | | | After 100 sheets | | | After 1000 sheets | | |
|---|---|---|---|---|---|---|---|---|---|
| | Depth | Ghost | Fogging | Depth | Ghost | Fogging | Depth | Ghost | Fogging |
| Example 1 | ○ | ○ | ○ | ○ | ○ | ○ | ○ | ○ | ○ |
| Example 2 | ○ | ○ | ○ | ○ | ○ | ○ | ○ | ○ | ○ |
| Example 3 | ○ | ○ | ○ | ○ | ○ | ○ | ○ | ○ | ○ |
| Example 4 | ○ | ○ | ○ | ○ | ○ | ○ | ○ | ○ | ○ |
| Comparative example 1 | ○ | ○ | ○ | ○ | Δ | ○ | Δ | X | ○ |
| Comparative example 2 | ○ | ○ | ○ | ○ | ○ | Δ | ○ | ○ | X |

As understood from Table 3, when only a direct current bias is applied between sheets and an alternating current bias is cut, ghosts are gradually increased and accumulated. In the comparative example 2 where a direct current bias is intentionally applied, though a ghost is suppressed, charge of toner varies so that generation of fogging is observed. Meanwhile, in the example 1–3 where the direct current field is extremely lowered or brought to zero and the alternating current potential is applied to the developing roll, even though after 1000 sheets printing, all qualities of the image concerning depth, ghost and fogging are excellent on account of effective replacement of toner on the developing roll.

Table 4 compares states of toner sticking to the developing roll 2 by printing a white pattern at the four point of the initial state, after 100 sheets printing, 1000 sheets printing and 10 000 sheets printing. In this Table 4, a mark ○ signifies the state where no toner sticking to the developing roll 2 is observed, a mark Δ signifies the state where a little toner sticking is observed and a mark x signifies the state where toner is sticking to all of the surface of the developing roll 2, contamination of the under part of the developing roll due to scattering of toner and fall off of toner from the developer are observed.

TABLE 4

| | Initial | 100 sheets | 1000 sheets | 3000 sheets | 10000 sheets |
|---|---|---|---|---|---|
| Example 1 | ○ | ○ | ○ | Δ | Δ |
| Example 2 | ○ | ○ | ○ | ○ | Δ |
| Example 3 | ○ | ○ | ○ | ○ | ○ |
| Comparative example 1 | ○ | Δ | X | X | X |
| Comparative example 2 | ○ | ○ | ○ | X | X |

As understandable from Table 4, in comparative example 1, a little toner was stuck to the developing roll after 100 sheets were printed. This is thought to be because the toner on the developing roll was scarcely replaced. Since the stuck toner was not concerned with the development but stayed on the developing roll all the time, the charge of the newly carried toner was lowered, which caused scattering of toner. Moreover, owing to lowering of the toner charge, an image depth of the stuck part became deep. A developing ghost remarkably appeared since the toner layer taking part in development became thin due to the charge of the stuck toner. After 10 000 sheets printing, contamination under the developing roll and toner falling from the developer occurred noticeably.

In comparative example 2, though toner was not observed to be stuck after 100 and 1000 sheets printing, toner was observed to be stuck to all over the developing roll after 3000 sheets printing. Measuring toner charge of the two component developer material, the charge was as high as 16 $\mu$C/g at initial stage, it was lowered to 5 $\mu$C/g after 3000 sheets printing. The thickness of the toner layer on the developing roll of 1.4–1.6 mg/cm$^2$ at initial stage was turned increasingly to 2.5–2.8 mg/cm$^2$ after 3000 sheets printing. Further, measuring toner charge distributions in the two component developer material, it was 90% frequency of 2.2±0.5 fC/$\mu$m at the initial stage. On the contrary, it was fairly broadened to be 50% frequency of 0.7±0.5 fC/$\mu$m after printing 3000 sheets.

This is thought to be because, as mentioned above, the highly charged toner on the developing roll was abruptly mixed with the comparatively lightly charged toner in the two component developer material owing to recovering toner from the developing roll to the magnetic roll with the direct current bias.

Meanwhile, in example 1–3, toner did not stick at all from the initial stage until 1000 sheets had been printed. The situation changed at 3000 sheets printing so that example 2 brought a better result than example 1 and example 3 brought a better result than example 2 in view of sticking of toner. From this result, it is understandable that toner sticking to the developer roll 2 was reduced since toner on the developing roll was replaced properly by decreasing the duty ratio (the positive duty ratio because using the toner charged positively) of alternating current potential consisting of a rectangular wave applied to the developing roll to lower than 45%.

Thus, it is preferable that the duty ratio is less than 45%, particularly understandable from Example 3 of Table 1, because the toner on the developing roll is properly replaced by applying alternating current potential of 1.3 kV and 50% of duty ratio to the developing roll and by bringing the direct current potential difference between the developing roll and magnetic roll to zero as rotating the magnetic roll and the developing roll after or before printing or at the intermission of printing. Problems of toner sticking to the developing roll, developing ghost and toner scattering are thereby solved.

In explanation of aforementioned embodiment, though the potential of the developing roll and the magnetic roll for equalizing set to 0 V, it may be e.g. 50 V each because it may be applicable if both surface potentials are equal to each other. Further, the equal state may be achieved by controlling the surface potential of both the developing roll 2 and the magnetic roll 1 or by controlling so as to coincide one surface potential to another or by bringing only a part of image-non-forming period to the equal potential state.

According to the present embodiment, it is possible to get rid of variation of charge distribution of toner at the replacement period while replacement of toner in the magnetic brush and on the developing roll with alternating current bias is enhanced by applying only alternating current bias generating an equal potential state of equalizing surface potential as rotating the developing roll and the magnetic roll at the image-non-forming period.

According to the present embodiment, an alternating current bias having a rectangular wave is applied to the developing roll. In case positively charged toner is used, positive duty ratio is less than 45%. In case negatively charged toner is used, negative duty ratio is less than 45%. Thereby toner on the developing roll is appropriately replaced and problems such as toner sticking to the developing roll 2, developing ghost and scattering of toner are solved. As described above, generation of ghost at successive developing is prevented without complicating the developing device and properly charged toner can be supplied to the developing roll.

Further, according to the present embodiment, replacement of toner on the development roll to the magnetic brush can be enhanced by controlling the length between the recording media longer than the process circumferential length whereby a stable image quality can be obtained for a long time even at successive printing.

Further, according to the present embodiment, the rotating speed of the magnetic roll 1 needs to be slightly faster than the rotational speed of the developing roll. Toner on the developing roll is replaced by the contact of the magnetic brush with the developing roll and the difference in rotational speeds ensures the proper replacement of toner.

Figure 9:
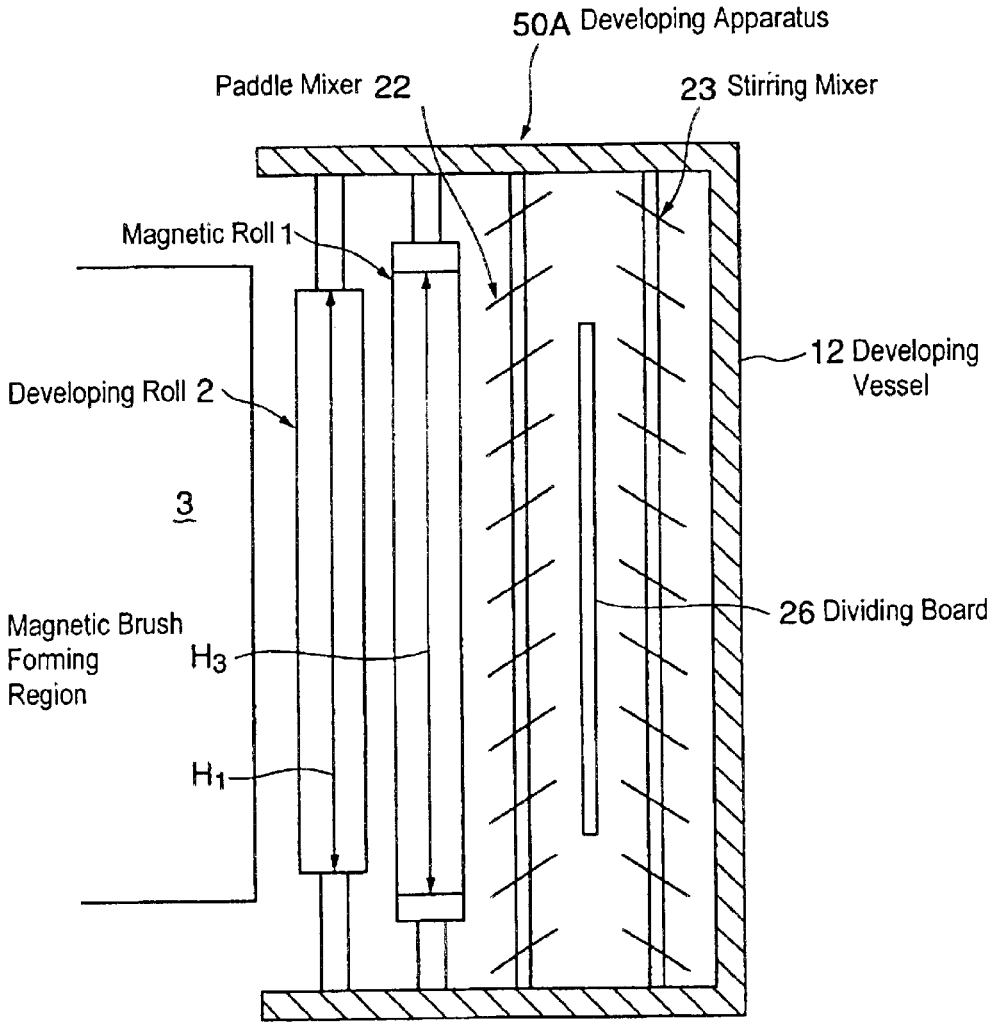
FIG. 9 is a schematic drawing illustrating a model of relationship between a photosensitive body and a developing unit of one embodiment according to the present invention
Figure 10:
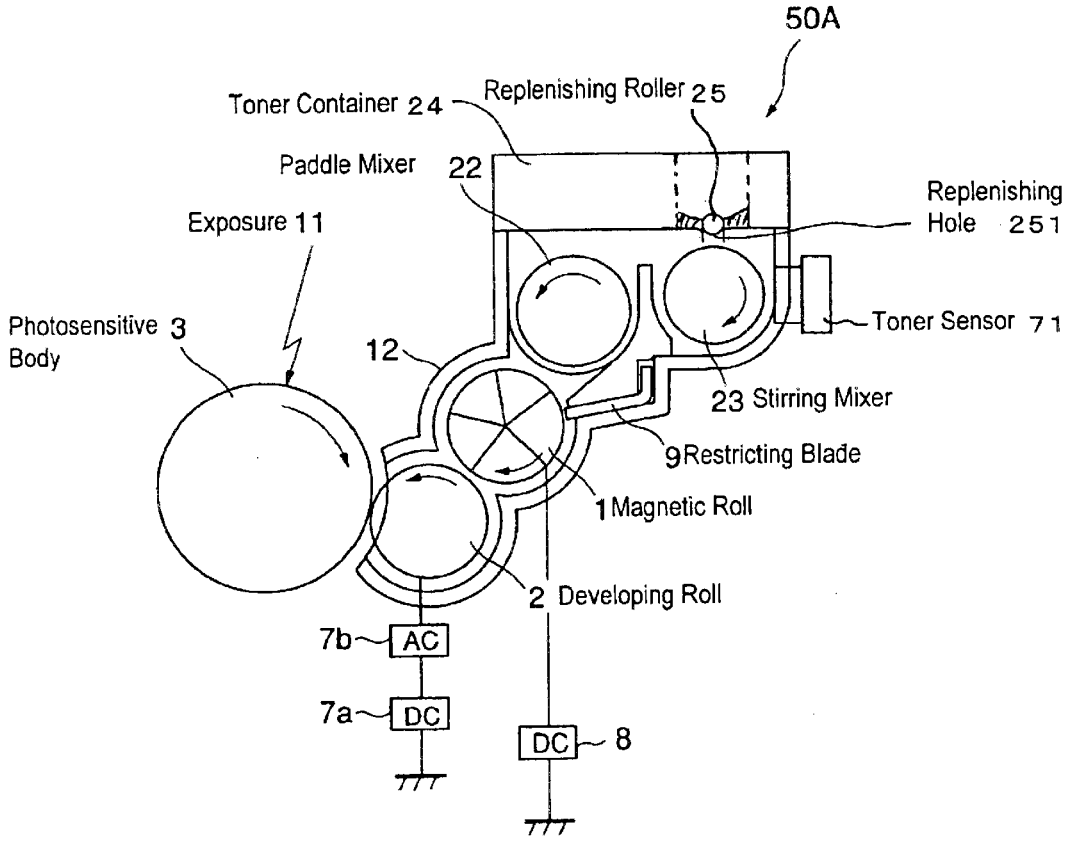
FIG. 10 is a sectional view of FIG. 9

Now, the construction of a developing unit 50 used in the present embodiment is explained as follows. In FIG. 5 and FIG. 6, though four kinds of developing units are disclosed, these have the same action. A developing unit 50A using black toner is explained as a typical example. FIG. 9 is a cross sectional side elevation view of a developing unit 50A. FIG. 10 is a cross sectional plan view, FIG. 12 is a perspective view and FIG. 13 is a diagrammatic illustration of a first embodiment of the developing roll 2.

A developing roll 2 is disposed at a prescribed distance apart from a photosensitive body 3 in a frame body 12. A magnetic roll 1 is disposed at a prescribed distance apart from the developing roll 2. The magnetic roll is formed cylindrically with non-magnetic metal material. The cylinder has a plurality of fixed magnets therein. A sleeve is disposed rotatably around the fixed magnets. A width $H_3$ in axial direction of the sleeve is formed longer than a width Hi in axial direction of the developing roll.

22 is a paddle mixer. A DC bias 7*a* and an AC bias 7*b* is applied between the photosensitive body 3 and the developing roll 2. DC 8 is a bias applied to the magnetic roll 1. 9. A restricting blade 9 restricts the thickness of magnetic brush. 25 is a toner sensor.

Figure 12:
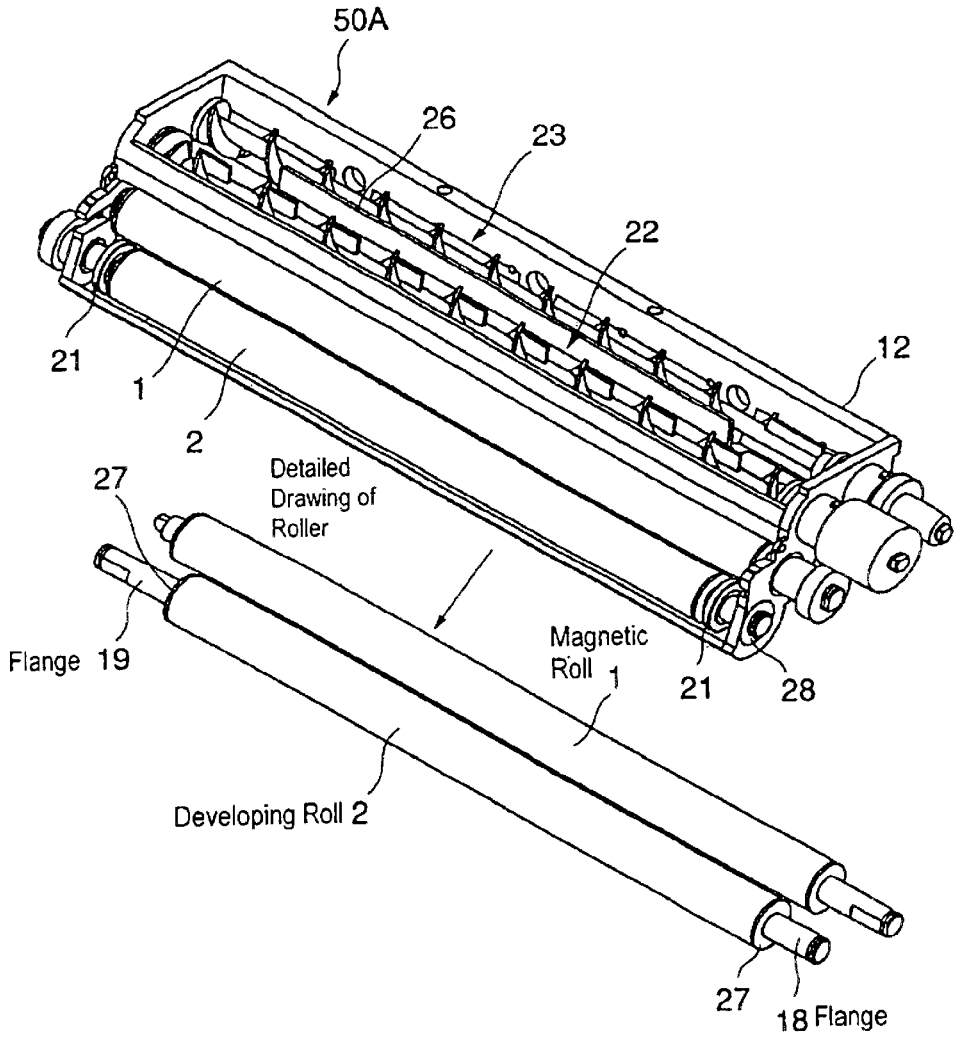
FIG. 12 is a perspective view of a developing unit according to one embodiment of the present invention.
Figure 13:
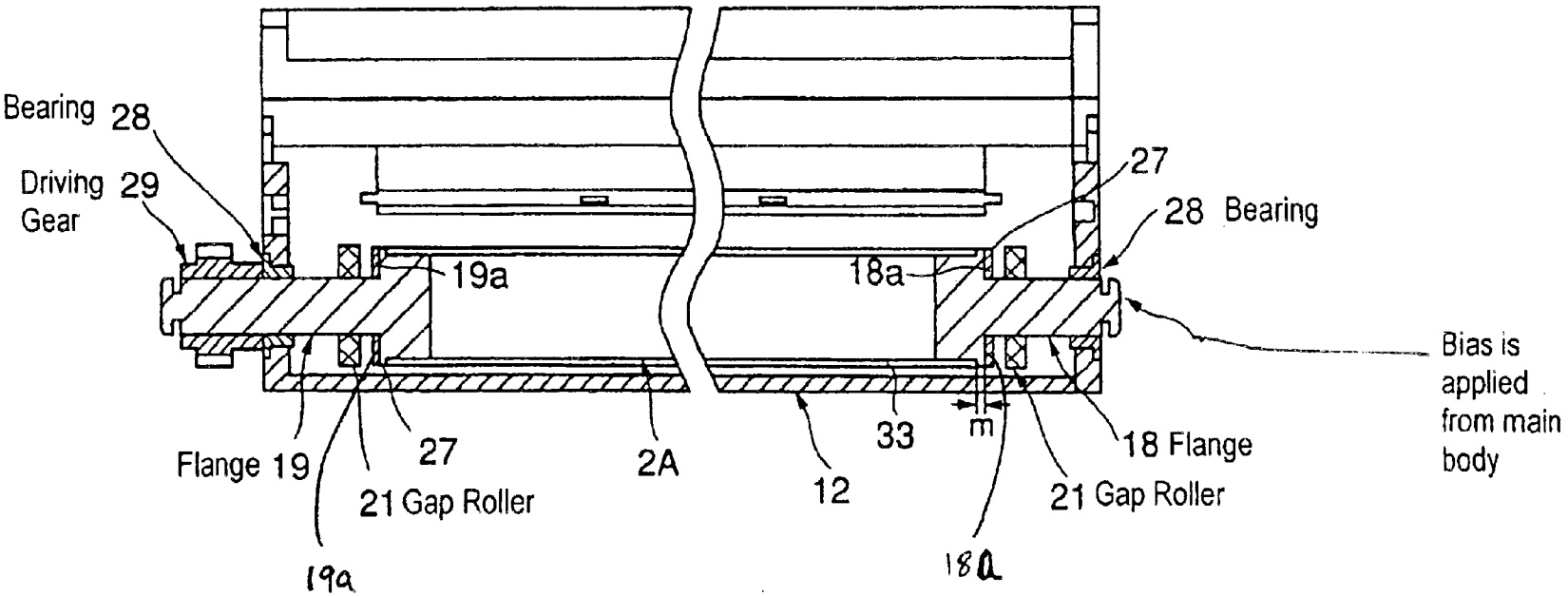
FIG. 13 is a sectional construction view showing a developing roll used in the invention shown in FIG. 9.

Now, a construction of the magnetic roll is further explained in detail using FIG. 12 and FIG. 13. A developing roll 2A comprises a cylindrical sleeve 33 of non-magnetic material, one end of which is fitted to a large diameter part of a flange 18 of aluminum. A bearing 28 of insulating material supports a small diameter part of the flange 18 rotatably to a developing vessel 12. A tip of the small diameter part is connected to the bias electric source 7 (in FIG. 1) with an unshown terminal and lead wire.

The outer plane 18*a* of the flange 18 is laminated with an insulating sheet 27 of PET (polyethylene terephthalate). The outer plane 18*a* of the flange 18 is apart from the end of the cylindrical sleeve 33 having the distance of m mm.

The small diameter part of the flange 18 is rotatably fitted to a gap roller 21, which restricts a distance between the surface of the photosensitive body 3 and the surface of the cylindrical sleeve 33 of the developing roll 2A.

The ends of the cylindrical sleeve 33 are fitted to a large diameter part of a flange 19 of aluminum. The bearing 28 of insulating material supports a small diameter part of the flange 19 rotatably to the developing vessel 12. The small diameter part of the flange 19 is rotatably fitted to the gap roller 21, which restricts the distance between the surface of the photosensitive body 3 and the surface of the cylindrical sleeve 33 of the developing roll 2A.

A tip of the small diameter part of the flange 19 is protruded outwardly from the frame body 12. The tip is fitted to a driving gear 29 for getting driving force from an unshown driving source.

The outer plane 19*a* of the flange 19 is also laminated with an insulating sheet 27 of PET (polyethylene terephthalate). The small diameter part of the flange 18 is rotatably fitted to a gap roller 21, which restricts the distance between the surface of the photosensitive body 3 and the surface of the cylindrical sleeve 33 of the developing roll 2A.

Though the flange 19 was made from conductive material, it may also be made from insulating material, in which case the insulating sheet 27 is unnecessary.

Since the developing roll 2A has the flanges 18, 19 both ends of which are covered with insulating material, toner is not stuck to both ends by the magnetic brush 10 of the magnetic roll 1 so that toner is not scattered due to the remaining toner on both ends which can not be recovered to the magnetic roll 1.

Now, the action of the photosensitive body, magnetic roll 1 in the developing unit 50 and developing roll 2 are explained in the following.

This process unit has, as shown in FIG. 1, FIG. 10 and FIG. 5, a magnetic roll 1, a developing roll 2 whose diameter is 16 mm and a photosensitive body 3.

The magnetic roll 1 generates a magnetic brush 10 consisting of a carrier 4, which charges and holds toner 5. A toner thin layer is formed with toner 5 supplied by the magnetic brush 10 on the surface of the developing roll 2. An image is formed on the photosensitive body 3 by selectively causing toner of the toner thin layer 6 to jump across to an electrostatic latent image. Two components developer material is held on the surface of the magnetic roll. Toner 5 is charged to an appropriate level of 5–20 $\mu$C/g while developer material is stirred by a stirring mixer 23 and a paddle mixer 22. Developer material contacts the developing roll 2 by a definite layer thickness passing through the restricting blade 9.

The toner thin layer on the developing roll is set to the thickness of 10–100 $\mu$m, more preferably 35–70 $\mu$m. The thickness value corresponds to 5–10 layers of toner particles when an average particle size is 7 $\mu$m.

The gap between the developing roll and the photosensitive roll is 150–400 $\mu$m, preferably 200–300 $\mu$m. A gap narrower than 150 $\mu$m causes fogging. A gap broader than 400 $\mu$m causes the difficulties to cause toner to jump across to the photosensitive body so that enough image depth cannot be obtained and causes selective developing.

As developer material has the role of recovering and supplying toner, a high resistivity or insulating carrier having a volume resisitivity of higher than $10^4$ Ωm and lower than $10^7$ Ωm is used. The magnetic brush 10 tears off toner 5 stuck electrostatically firmly with the nip of carrier 4 formed between the developing roll and the magnetic roll by rubbing the surface of the developing roll and supplies toner necessary for developing to the developing roll.

In order to increase contact points to toner 5 in this occasion, it is preferable to supply a lot of toner 5 to the developing roll 2 using carrier having a particle size smaller than 40 μm and to increase magnetic brush 10 so that the surface area of carrier 4 is increased for increasing magnetic brush density.

Further, in the present embodiment, a carrier 4 comprises a carrier core material having magnetization and a coating layer containing high molecular weight polyethylene resin formed by polymerization on the surface of the carrier core material. The carrier is ferrite carrier of an average particle size of 35 μm having a resistivity of $10^5$–$10^6$ Ωm and a saturated magnetization of 60–100 mA $m^2$/g. The coating layer herein have at least a layer containing hydrophobic silica, magnetic powder and/or small particle resin as an outermost shell layer.

More specifically, the carrier core material has a roughness in which ethylene polymerization catalyst is held and ethylene gas is directed to polymerize to high molecular weight polyethylene having a weight average molecular weight of more than 50 000.

Accordingly, the carrier has a high strength and durability so that the carrier deteriorates little even if repeatedly used. Thereby, a stable charged toner thin layer could be formed. Consequently, accurate development is possible on the photosensitive body. As the carrier's durability is high, the carrier doesn't need to be changed until the developing apparatus' end of life.

A low resistivity carrier of a resistivity of $10^6$ Ωcm or lower is good for toner recovery and effective for combating ghost image formation. However, such a carrier has difficulties in giving accurately charged toner in order to maintain developing without generating fogging on the image. Furthermore, toner scatters from the surface of the developing roll to contaminate chargers or an exposing device 57 in case of a long print run.

A carrier of a resistivity of $10^7$ Ωm or higher gives charge ability but has a problem that charge is apt to increase. It is possible to supply properly charged toner again on the developing roll 2 while recovering toner on the developing roll by using a carrier having an appropriate resistivity.

As for a mixing ratio of toner in the present embodiment, a total mixture of carrier and toner contains 2%–40% by weight of toner, preferably 3%–30% by weight, and more preferably 4%–25% by weight.

If a mixing ratio of toner is less than 2% by weight, the toner charge cannot be sufficiently increased to achieve sufficient image depth. If a mixing ratio of toner is more than 40% by weight, insufficient toner charge can be obtained and toner scatters from the developer to contaminate the inner part of the image forming apparatus or generate fogging on the image.

The charged toner is held on the developing roll 2 as a thin layer by potential difference between the magnetic roll 1 and the developing roll 2. An image is developed by applying a combined bias of direct current plus alternating current. In order to avoid scattering of toner, alternating current is applied just before the application of direct current.

A brush effect of rotating difference of both rolls generated by contacting the magnetic brush on the magnetic roll 1 to the toner layer on the developing roll 2 and replacement of developer material by stirring developer material of the magnetic brush enable recovery and replacement of toner.

The magnetic roll 1 rotates at a rotational rate 1.8 times the rotational rate of the developing roll 2 to recover toner on the developing roll as a method for enhancing replacement on the developing roll 2. A uniform toner layer can be formed by supplying developer material adjusted to an appropriate toner concentration.

In order to maintain a uniform developing concentration, it is effective to recover toner on the developing roll 2 to the magnetic roll 1 without undertaking load for toner by equalizing the potential difference between the developing roll 2 and the magnetic roll 1 at the period except for the developing period.

When a-Si is used as a photosensitive material of the photosensitive body 3, the potential of the surface after exposure indicates a characteristically very low value of 10 V or lower. If the film thickness is decreased, the saturated charge potential decreases so that the dielectric breakdown voltage also decreases.

Meanwhile, a charge density on the surface of the photosensitive body 3 increases and developing property tends to improve when a latent image is formed. This characteristics is remarkable when the film thickness is 25 μm or thinner, more preferably 20 μm or thinner in case of an a-Si photosensitive body having a dielectric constant of about 10.

Referring to FIG. 1, a power source comprising a first direct current power source 7*a* which apply 0–200 V bias between the photosensitive body and the developing roll 2 and an alternating current power source 7*b* is provided. Further, the alternating current power source 7*b* applies an alternating current voltage of a peak voltage of $V_{pp}$= 500–2000 V and a frequency of f=1–3 kHz to the electrostatic latent image bearing body (photosensitive body) 3.

A second direct current power source 8 which applies a voltage $V_{dc2}$ to the magnetic roll 1 is provided. Voltages of the first and second direct current power sources are determined so that a potential difference $\Delta=|V_{dc2}-V_{dc1}|$ between the developing roll 2 and magnetic roll 1 is 100–350 V. For example, $V_{dc2}$ is set to 250 V and the developing bias $V_{dc1}$ is set to 150 V or lower, more preferably to 100 V or lower. Further, $|V_{dc2}-V_{dc1}|$ is preferably set to 100–250 V. And the AC component is set to $V_{pp}$ of 500–2000 V and a frequency of 1–3 kHZ.

The size of a magnetic brush 10 on the magnetic roll 1 is restricted by a restricting blade 9. A toner thin layer 6 is formed on the developing roll 2 by the potential difference $\Delta=|V_{dc2}-V_{dc1}|$ between the magnetic roll 1 and the developing roll 2.

Though the toner thin layer 6 on the developing roll 2 varies with the resistance of developer material or the rotational rates difference of the developing roll 2 and the magnetic roll 1, it can be controlled by the aforementioned potential difference Δ.

The greater Δ is brought to, the thicker the toner layer 6 on the developing roll 2 becomes. The smaller Δ is brought to, the thinner the toner layer 6 on the developing roll 2 becomes. A range of Δ is generally appropriate about from 100 V to 250 V.

Now, effects of the bias voltage $V_{dc1}$ and the potential difference $|V_{dc2}-V_{dc1}|$ on the developing property is explained from results of experiments.

If the bias voltage $V_{dc1}$ is higher than 200 V, ghost appears. If the potential difference $|V_{dc2}-V_{dc1}|$ is less than 100 V, also ghost appears.

Meanwhile, if the potential difference $|V_{dc2}-V_{dc1}|$ is greater than 350 V, fogging appears.

Therefore, an image of high quality can be obtained when the bias voltage $V_{dc1}$ is within the range of 0–200 V (provided that 0 V is excluded,) and the potential difference $|V_{dc2}-V_{dc1}|$ is within the range of 100–350 V.

An OPC photosensitive body has been well known heretofore as a photosensitive body used in the image forming apparatus. The OPC photosensitive body has a soft surface of its photosensitive layer and has a problem that the layer is apt to peel off by rubbing with cleaning blade. Consequently, an a-Si photosenstive body having a photosensitive layer thickness of 25 μm or thicker has been used lately because the surface is hard and durability or function-maintaining property (maintenance-free) is excellent in comparison to the OPC photosensitive body. However, since the a-Si photosensitive body is prepared by a glow discharge decomposition method, it takes time and cost to produce in the case of a thick photosensitive layer. So it is at an economic disadvantage.

When a positively charged organic photosensitive body (OPC) is used, in order to lower a residual potential to 100 volts or under, it is important that the film thickness of the photosensitive layer is set to be 25 μm or thicker and charge material is increased to be added. Particularly, monolayer OPC is advantageous because sensitivity change is little even if the film is worn abrasively due to addition of charge generating agent.

Even in this case, the developing bias is preferably 400 V or lower, more preferably 300 V or lower for preventing the application of a strong electric field to the toner.

To set the developing bias low like this is effective for preventing dielectric breakdown of thin a-Si film of the photosensitive body, for preventing excessive charge of toner and for preventing to generate a hysteresis of developing. The toner layer of 10–100 μm, preferably of 35–70 μm is formed on the developing roll. The gap between the developing roll 2 and photosensitive body 3 of 150–400 μm, preferably of 200–300 μm is provided. Toner is filed in the space by a direct current and an alternating current electric field whereby a clear image is obtained.

Again referring to FIG. 1, when image forming, if developer material comprising the carrier 4 held on the magnetic roll and toner 5 is stirred while toner 5 is charged to an appropriate level, developer material generates magnetic brush 10, which contacts the developing roll 2 with a definite thickness by passing through the restricting blade 9. The gap between the restricting blade 9 and the magnetic roll 1 is 0.3–1.5 mm herein.

The gap between the magnetic roll 1 and the developing roll 2 is likewise 0.3–1.5 mm.

The gap between the developing roll 2 and the photosensitive body 3 is 150–400 m, preferably 200–300 m. When the toner thin layer 6 is formed under such gap and applied voltage condition, the thickness of the toner thin layer 6 is found to be 10–70 m preferably 35–70 m.

The developing roll is rotated at a circumferential rotational rate of 72 mm/s and the magnetic roll is rotated at a rate 1.8 times that of the developing roll. As a result, residual toner of developing and supplying toner can be exchanged with ease with a brush effect of the circumferential rate difference. Consequently, a clear image can be formed while preventing the generation of a ghost.

According to the present embodiment, a equal potential state that the surface potential of the developing roll 2 is equalized to that of the magnetic roll is generated at the image-non-forming period, which is a period from the end of development of one image to the beginning of the next successive developing when a plurality of images are successively formed. And the residual toner of the toner layer 6 on the developing roll 2 is recovered with the magnetic brush at the equal potential state.

The image-non-forming period may be detected based on the image data printed, or for example, based on the front end or the rear end of the recording sheet at a sheets supplying device.

According to the present embodiment, the distance between recording sheets corresponding to an image-non-forming period, that is the distance from the rear end of a sheet to the front end of the next successive sheet when sheets are fed is set to 51 mm. Meanwhile, as the diameter of the developing roll 2 is 16 mm, the total circumferential length comes to 16=50.27 mm. Therefore, if the equal potential state is made for all of the image-no-forming period, the equal potential state can last for at least one rotation of the developing roll.

In order to evaluate the effect of the present embodiment, experiments were made as an example and comparative examples. The example is a case where the surface potential of both of the image roll and the magnetic roll is 0 V within the image-non-forming period. The comparative examples are cases where different potentials are applied to the image roll and the magnetic roll. After running these experiments, the extents of the image depth, the ghost and the fogging were observed.

Figure 11:
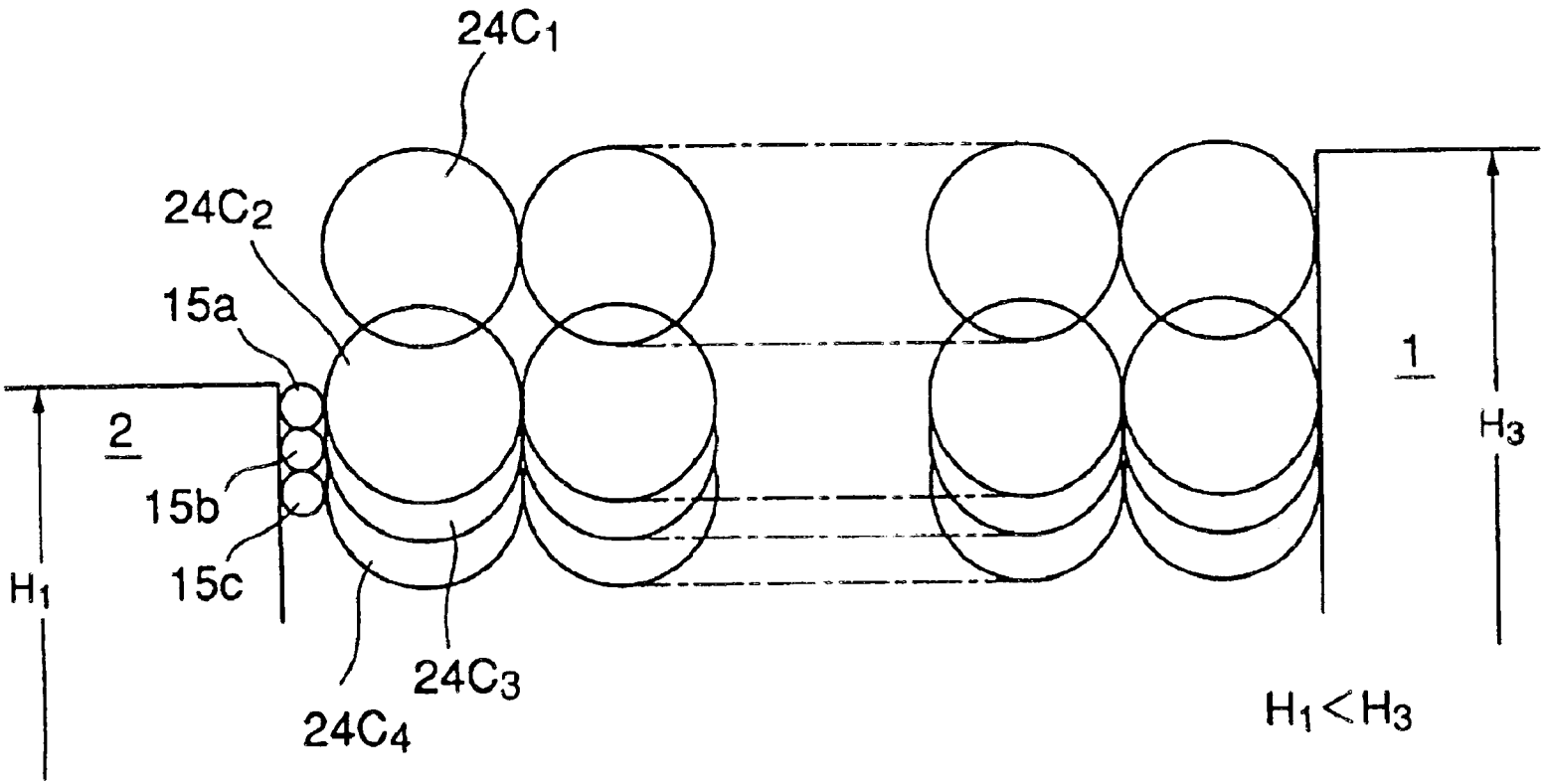
FIG. 11 is a schematic drawing illustrating a state of recovering residual toner according to one embodiment of the present invention.

As shown in FIG. 11, a sleeve axial width on which the magnetic brush of the magnetic roll 1 was formed and an axial width on which the toner thin layer of the developing roll 2 was formed were set to the same size as $H_1$ so that relative height positions of both did not deviate.

EXAMPLE

In the following example, comparative example 1 and comparative example 2, an image pattern shown in FIG. 4 was formed. With regard to this image pattern, a rectangular solid pattern 13 and a half tone image 16 broader than the solid image 13 are disposed in such manner that the half tone pattern 17 is developed successively after solid pattern 13 is developed.

Here, the depth of the half tone image 17 is 25% that of the solid image 13. A ghost image appears comparatively easily under the condition of 25%.

A photosensitive body 3 having an a-Si photosensitive layer of 14 μm thickness was used in this example.

At the image forming period, the surface potential of photosensitive body 3 is set to 200 V, the surface potential ($V_{dc1}$) of developing roll 2 is set to 50 V and the surface potential ($V_{dc2}$) of magnetic roll 1 is set to 200 V An alternating voltage of a frequency of 2.4 kHz and of a peak voltage of 1.3 kV is applied between the photosensitive body 3 and the developing roll 2. The magnetic roll 1 is rotated at 1.8 times the speed of the developing roll 2.

In this example, an equal potential state was made by setting both surface potentials of developing roll 2 ($V_{dc1}$) and the magnetic roll 1 ($V_{dc2}$) to 0 V at the image-non-forming period.

Comparative Example 1

In comparative example 1, an equal potential state was not made even at the image-non-forming period but the same bias potential as the image-forming period was applied to form an image.

The surface potential ($V_{dc1}$) of the developing roll 2 was set to DC 50 V, the surface potential ($V_{dc2}$) of the magnetic roll 1 was set to DC 200 V The same alternative current potential as that at the image-forming period was applied between the developing roll and the photosensitive body 3.

The same experimental condition as the example except for the bias potential at image-non-forming period was herein applied.

Comparative Example 2

In comparative example 2, an image was formed by applying reverse bias potential at the image-non-forming period.

The surface potential ($V_{dc1}$) of the developing roll 2 was set to DC 200 V and the surface potential ($V_{dc2}$) of the magnetic roll 1 was set to DC 50 V. The same experimental condition as the example except for the bias potential at image-non-forming period was herein applied.

After the image forming process was conducted on the above three conditions of example, comparative example 1 and comparative example 2, results were observed at the point of initial stage, at the point after 100 sheets printing and at the point after 1000 sheets printing with regard to depth, ghost and fogging.

In example, at any points of initial stage, after 100 sheets printing and after 1000 sheets printing, excellent images are obtained so that no scratchy image appeared concerning depth and ghost and fogging also did not appear.

On the contrary, in comparative example 1, since the same potential as at image forming period was also applied at the image-non-forming period, ghost had been accumulated gradually. As a result, ghost was observed a little at the point after 100 sheets printing and finally was observed clearly at the point after 1000 sheets printing.

In comparative example 2, since a potential at image-non-forming period was reversed, ghost was prevented, though, toner charge varied to generate fogging. Thus, fogging was recognized a little at the point after 100 sheets printing and apparently at the point after 1000 sheets printing.

Therefore, from the above evaluation result, it was found that a clear image could be formed while the generation of fogging and ghost was prevented by making an equal potential state at the image-non-forming period.

Figure 17:
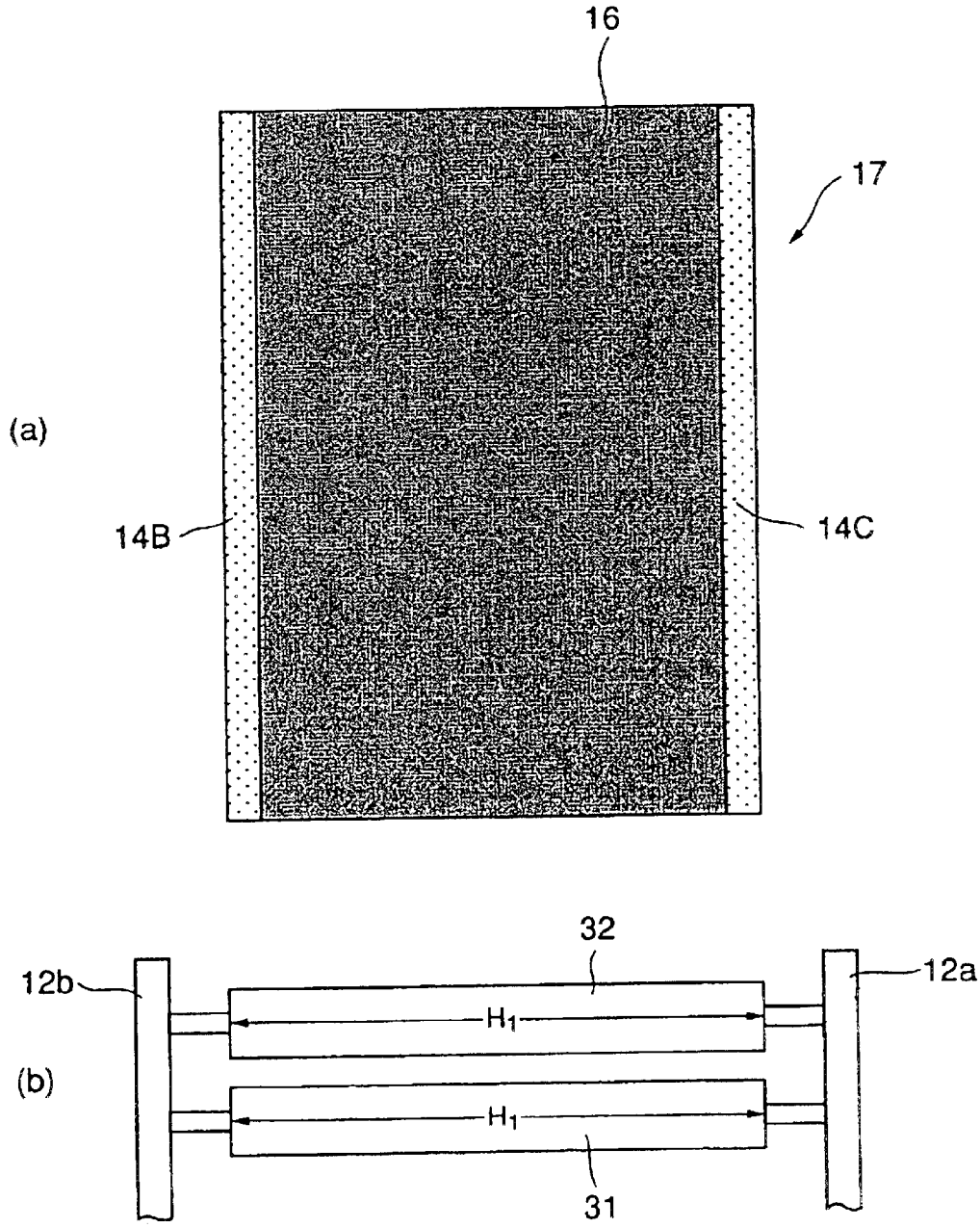
FIG. 17 is a schematic drawing showing a model of the state generating a ghost in order to explain a developing method of the present invention.

Next, as shown in FIG. 11, the width $H_3$ in the direction of the axis of the sleeve on which the magnetic brush of the magnetic roll 1 was formed by 0.5 mm longer at one side than the width $H_1$ in the direction of the axis of the roll on which the toner thin layer was formed. The half tone image shown in FIG. 17(*a*) was formed to test initial stage, after 100 sheets printing and after 1000 sheets printing. It was confirmed that excellent image was obtained at any stages without ghost, fogging and scratchy image. It ca be understood that residual toner 15*a*, 15*b*, 15*c* were recovered by carrier 24$C_2$, 24$C_3$, and 24$C_4$ of magnetic brush.

In the above mentioned embodiment, though the equal potential of developing roll 2 and the magnetic roll 1 was set to zero to make an equal potential state at the image-non-forming period, it is also applicable if their surface potentials are equal to each other, e.g. the potential of both rolls is 50 V.

In order to make the equal potential state, for example, the surface potentials of both rolls of the developing roll and the magnetic roll may be controlled; or, for example, it may be controlled such that one surface potential of the developing roll or the magnetic roll coincides with another surface potential of the developing roll or the magnetic roll.

As explained in detail above, an image forming apparatus, which does not have the developing hysteresis phenomenon on the developing roll and has an excellent property of recovery can be provided by preventing toner scattering and fogging. Since the magnetic brush forming region $H_3$ is the width of recovering toner on the developing roll 2, the unrecoverable region can surely be gotten rid of by making the width of the developing roll $H_1$ shorter than the width of the magnetic brush forming region $H_3$.

As a result, toner stuck to the region out of the magnetic roll on the developing roll sleeve can be gotten rid of and toner scattering of the both ends can be prevented.

At the image forming period, the toner layer is formed on the developing roll by the potential difference formed between the developing roll and the magnetic roll. At the image-non-forming period, the residual toner on the developing roll is recovered at the state of zero potential difference by the magnetic brush on the magnetic roll having greater circumferential rotating rate than that of the developing roll. Occasions on which the magnetic brush contacts the developing roll can be increased by rotating the magnetic roll faster than the developing roll in terms of circumferential rotating rate. At the same time, since the high shearing stress of the magnetic brush acts to the residual toner on the developing roll, a pressing force of the residual toner to the developing roll is decreased so that the residual toner can be recovered effectively at the equal potential by the high magnetic carrier even without applying a potential difference between the developing roll and the magnetic roll.

Figure 14:
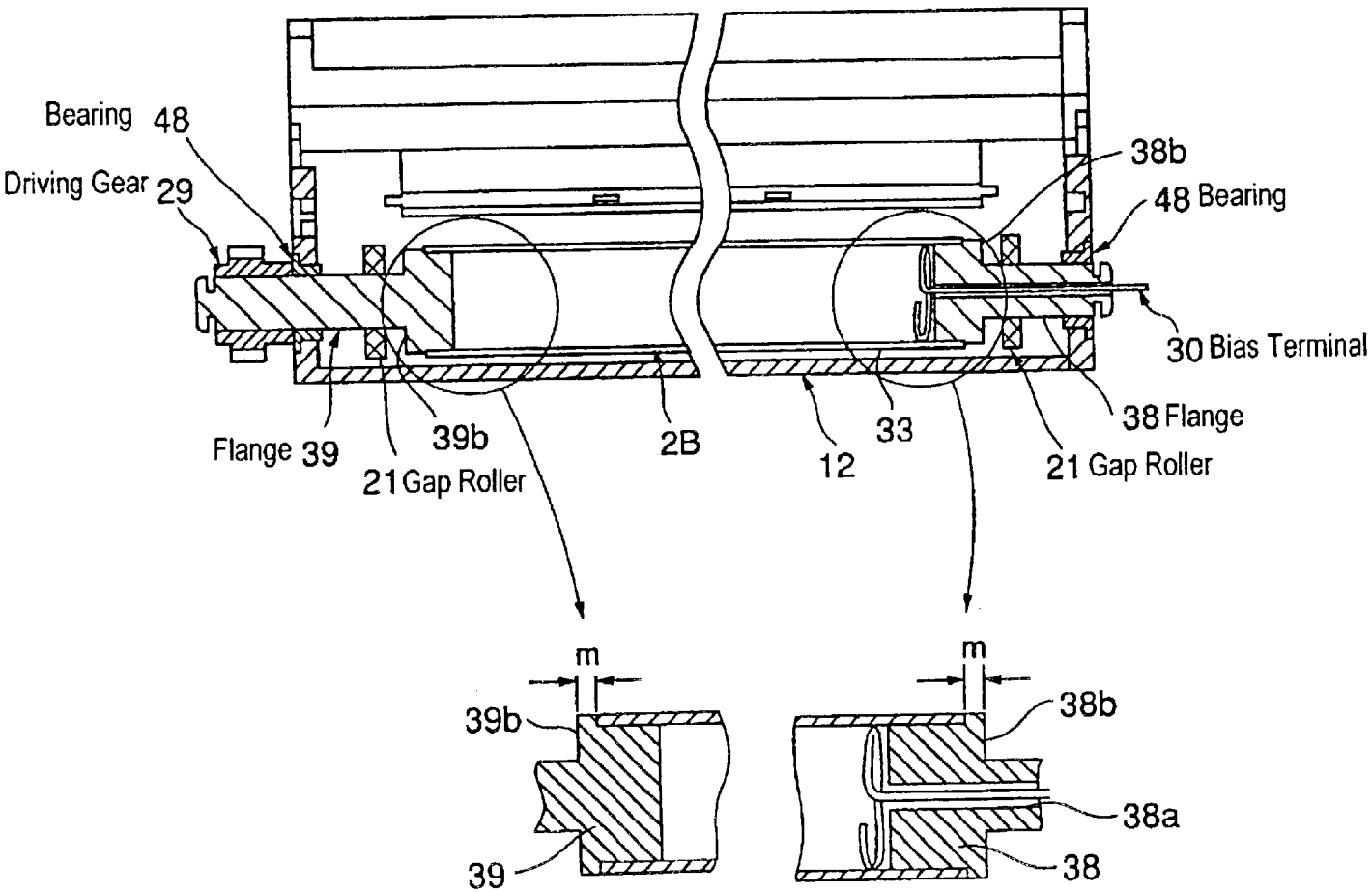
FIG. 14 is a sectional construction view showing another embodiment of a developing roll used in the invention shown in FIG. 9.
Figure 15:
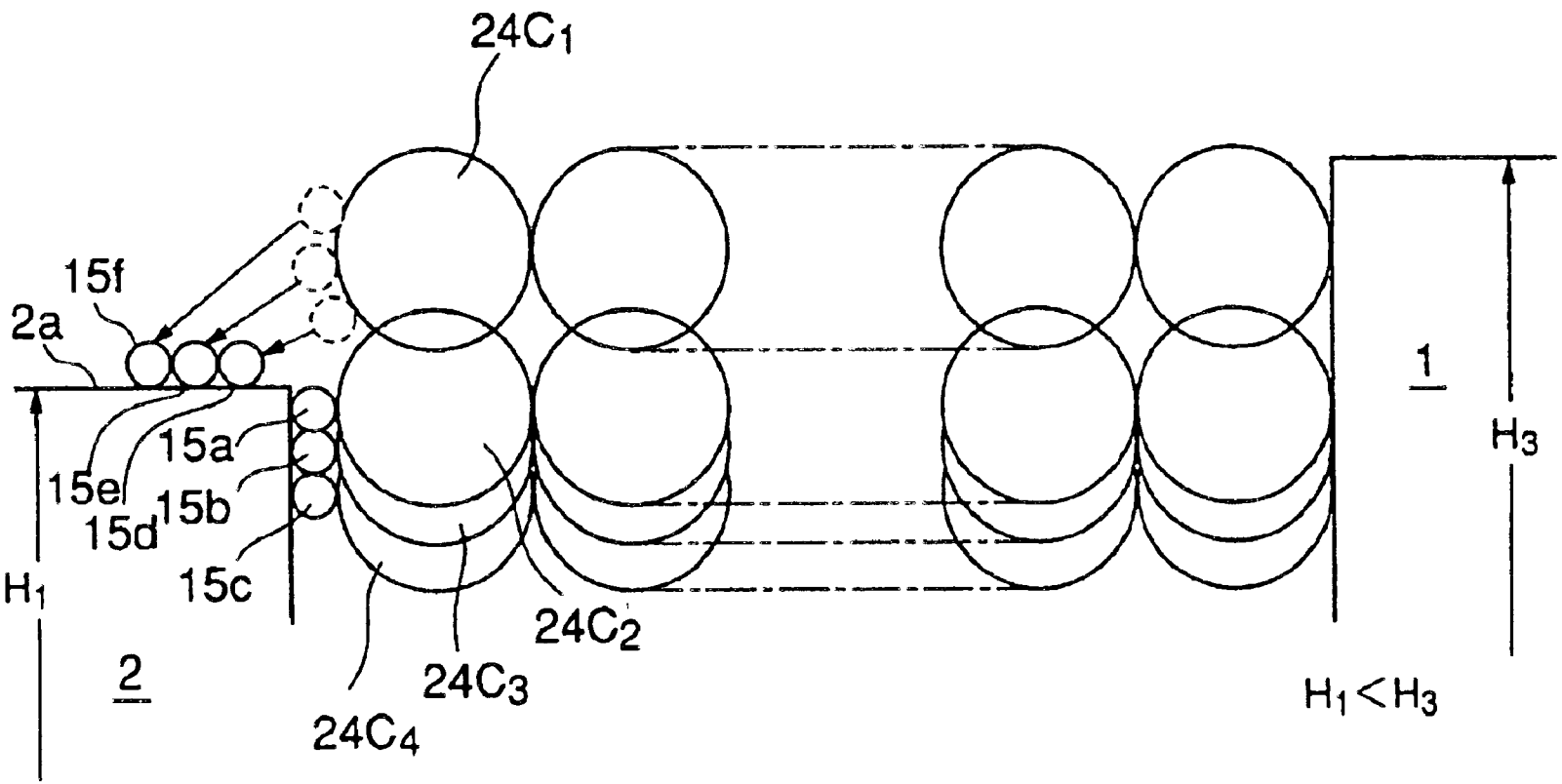
FIG. 15 is a second schematic drawing illustrating a state of recovering residual toner.
Figure 16:
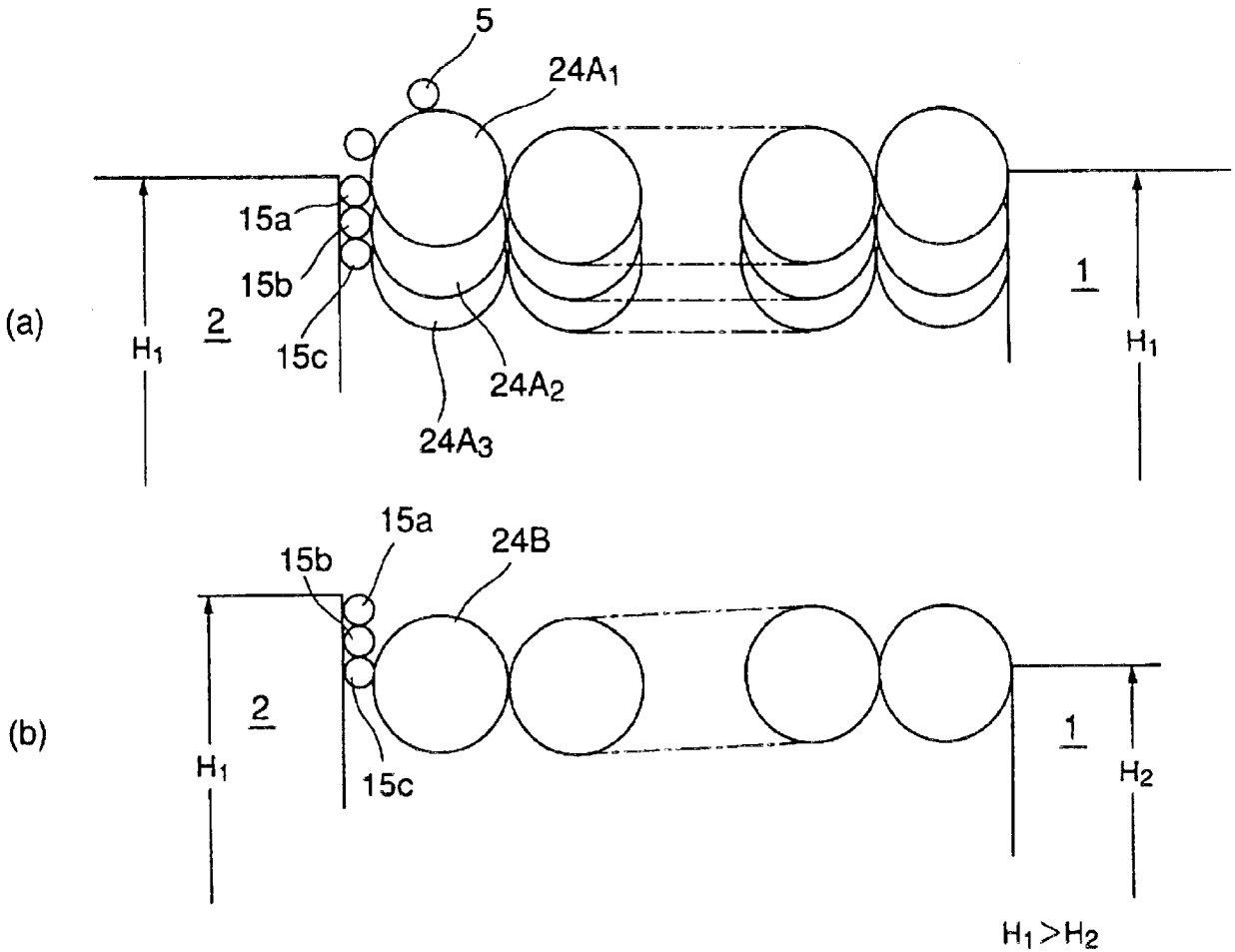
FIG. 16 is a third schematic drawing illustrating a state of recovering residual toner.

Referring to FIG. 14, a second embodiment of a developing roll is explained as follows. The different point between the first embodiment in FIG. 13 and the second embodiment is such that though conductive material is used in the flange of the first embodiment on the side plane of which insulating tape is affixed, insulating material is used to form the flange in the present second embodiment.

As shown in FIG. 14, according to the present second embodiment, a developing roll 2B comprises a cylinder 33 of conductive aluminum to one end of which a larger diameter part of a flange 38 consisting of POM (polyacetal) material is fixed with a distance of m (approximately 1 mm) between the end plane of the cylinder 33 and flange 38*b*. A small diameter part of the flange 38 is supported rotatably with a metal bearing 48 to a frame 12. A tip of the small diameter part is protruded from the frame 12 and has a hole 38*a* in the direction of the axis of the developing roll 2B. A bias terminal 30 of spring material is disposed in the hole 38*a* and connected to the bias power source 7 (shown in FIG. 1) with a terminal and a lead wire, which is not shown. The bias terminal forms a round contact ring, which contacts the inner face of the cylinder.

A gap roller 21 restricting the gap between the surface of the photosensitive body 3 and the surface of the cylinder 33 of the developing roll 2B is rotatably fixed to the small diameter part of the flange 38.

A larger diameter part of a flange 39 consisting of POM material is fixed to another end of the cylinder 33 with a distance of m (approximately 1 mm) between the end plane of the cylinder 33 and flange 39*b*. A small diameter part of the flange 39 is supported rotatably with a metal bearing 48 to a frame 12, from which a tip of the small diameter part is protruded.

A gap roller 21 restricting the gap between the surface of the photosensitive body 3 and the surface of the cylinder 33 of the developing roll 2B is rotatably fixed to the small diameter part of the flange 39. A tip of the small diameter part is fixed with a driving gear 29 for obtaining driving force from an unshown driving source.

According to the present embodiment, since the developing roll 2B has the flanges 38 and 39 consisting of insulating material, toner from the magnetic brush 10 of the magnetic roll does not stick to the side faces of the flanges 38 and 39 and therefore no toner is lost past these flanges.

Therefore, according to the present invention, since the toner thin layer region of the axis direction on the developing roll is defined smaller than the magnetic brush forming region of the axis direction on the magnetic roll, a large enough toner thin layer region can be formed on the surface of the corresponding developing roll to cover the electrostatic latent image on the photosensitive body.

Further, since the magnetic brush forming region of the axis direction on the magnetic roll is defined larger than the toner thin layer forming region of the axis direction on the developing roll, an enough toner thin layer region to cover the electrostatic latent image on the photosensitive body can be formed on developing roll. Thereby toner supply is not insufficient to the outer part of the electrostatic latent image region in the direction of width on the photosensitive body so that enough image forming is performed and ghost dose not appear by successful recovery of residual toner on the developing roll.

And, toner dose not stick to the side faces of the developing roll so that toner scattering is prevented to form excellent images.

Figure 18:
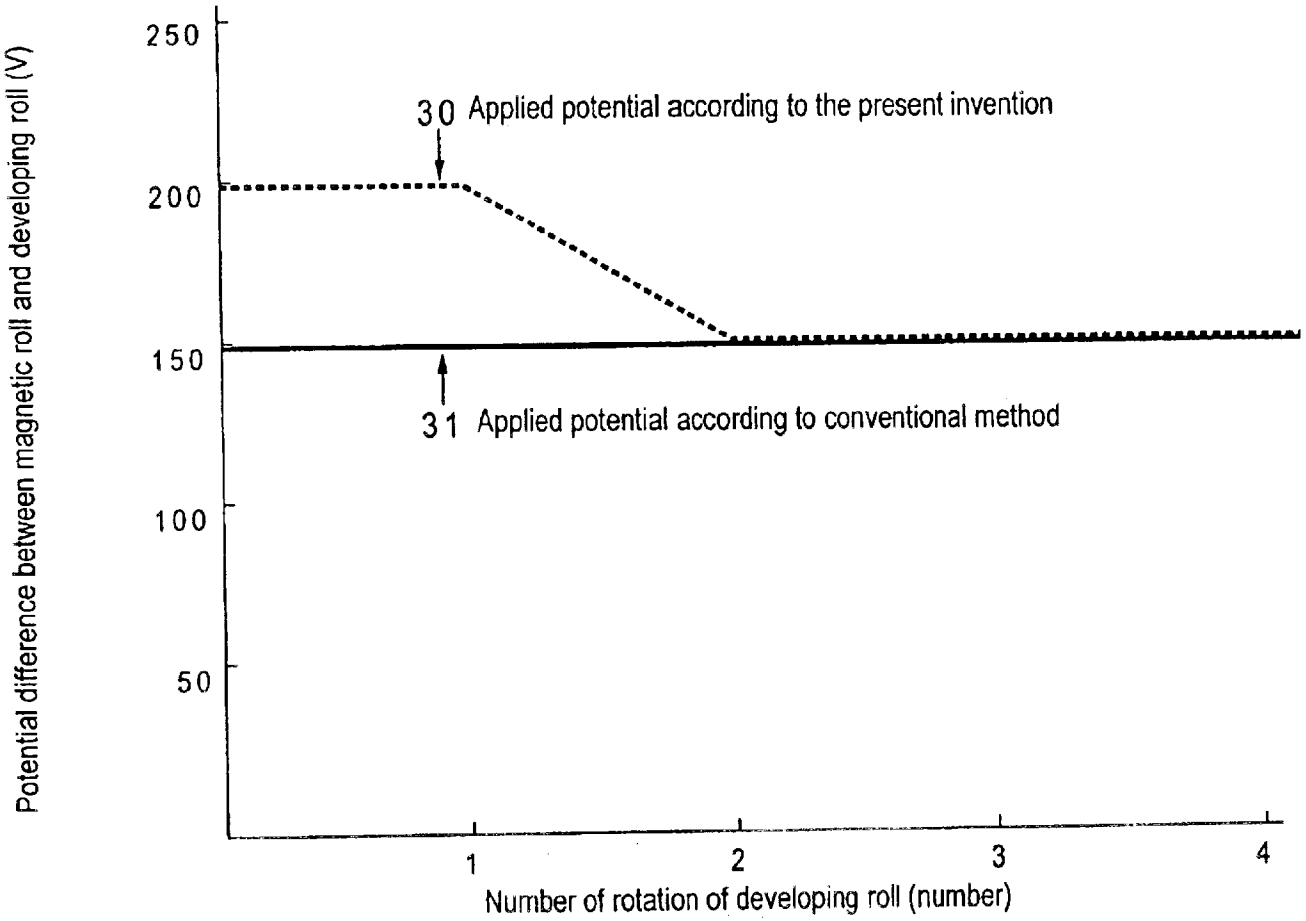
FIG. 18 is a graph showing the relation of the potential difference between a developing roll and a magnetic roll to the number of rotation of developing roll.
Figure 19:
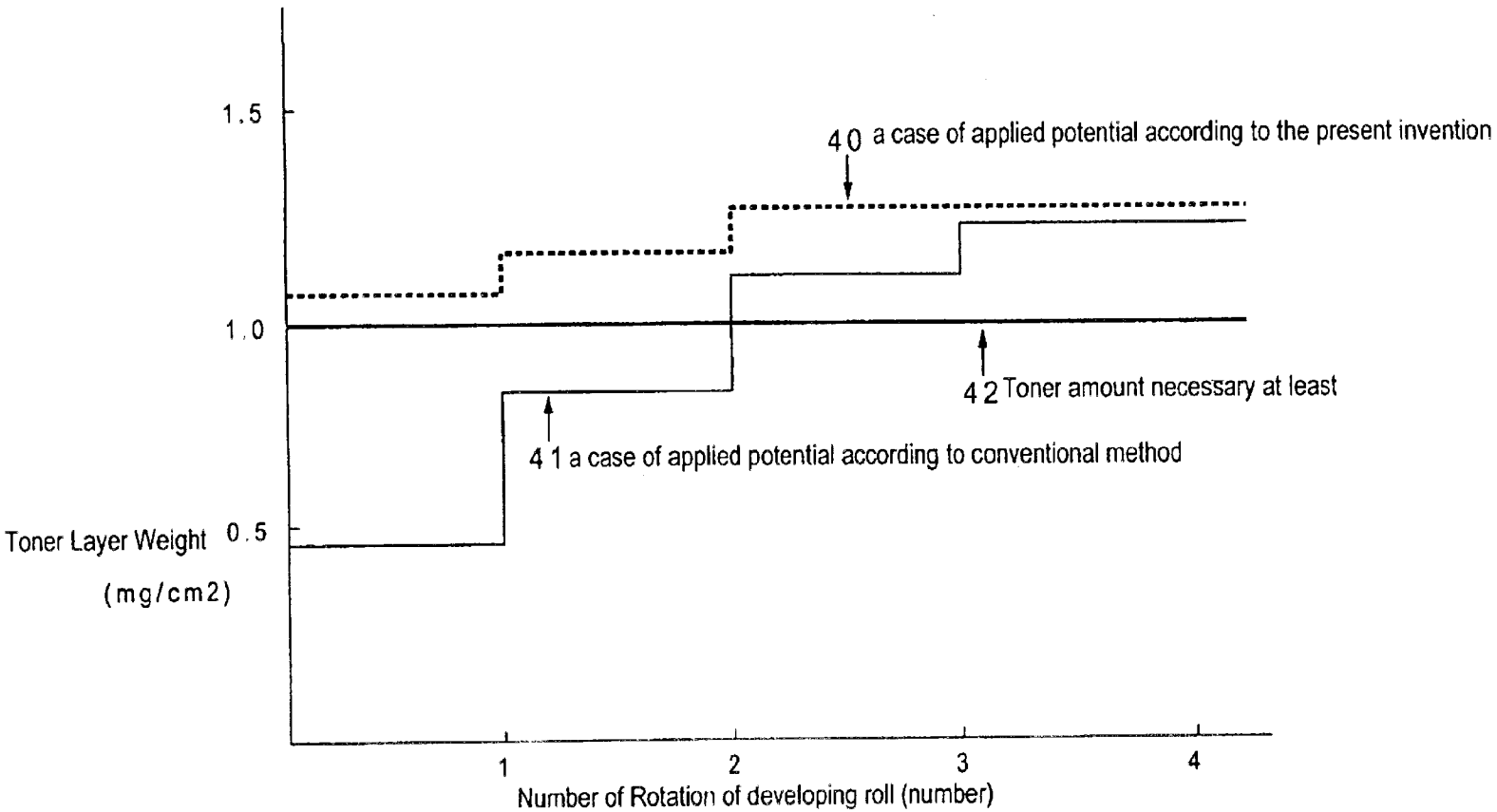
FIG. 19 is a graph showing a state of forming a toner layer with respect to the number of rotations of the developing roll according to the developing method of the present invention and the conventional method.

Referring to FIG. 1, FIG. 18 and FIG. 19, a developing method of the second embodiment according to the present invention is explained as follows. FIG. 18 is a graph showing a relation of potential differences between the magnetic roll and the developing roll rotational rates of the developing roll. FIG. 19 is a graph showing an effect of rotational rate of the developing roll on toner layer forming.

In the present embodiment, the potential difference 30 of the developing roll 2 at the first round from the beginning of developing is set to greater than that at the second round or later, as shown in FIG. 18 by varying the DC bias 7*a* of the developing roll shown in FIG. 1. Though the potential difference 30 can be set within the range of 100–250 V, when the standard potential difference is set to 150 V, it is appropriate to set the potential difference 30 of the developing roll 2 at the first round from the beginning of developing to approximately +50 V (+45–55 V). Too great potential difference causes toner scattering because of increased toner amount on the developing roll. The potential difference lower than 45 V gives imperfect effect.

In case the potential difference 30 of the developing roll 2 at the first round from the beginning of developing is set to equal to that at the second round or later as shown by the numeral 31 in FIG. 18, necessary toner amount 42 to obtain a uniform developing property cannot form on the developing roll 2 even at the second round of rotation of the developing roll as shown by the numeral 41 in FIG. 19, which causes ghost and decline of depth after successive printing. The phenomenon occurs on account of the disparity of toner amount on the developing roll after developing. As stated above in the present embodiment, the thickness of toner layer can be uniform from the first round of the developing roll, as shown by the numeral 40 in FIG. 19, by setting the potential difference 30 of the developing roll at the first round from the beginning of developing to greater than that at the second round or later.

Further in the present embodiment, an equal potential state of equalizing the DC surface potential 7*a* of the developing roll 2 to the DC surface potential 8 of the magnetic roll 1 is realized at the image-non-forming period from after an image is developed till the successive image begins to be developed or at any prescribed time period before beginning of forming an image, while the developing roll, the magnetic roll and the paddle mixer is rotated. The magnetic brush recovers the residual toner on the developing roll 2 on the condition of this equal potential state. The image-non-forming period may be the period before an image is formed; for example, the period from a signal of starting print arrives from an unshown control circuit till a recording medium is delivered to the conveying belt 54 from the sheet supplying cassette 53. The image-non-forming period may be detected based on the signal of starting print transmitted from the unshown control circuit, on the printing image data transmitted to the exposure unit 57 or on the front end or the rear end of a recording medium in the sheets supplying cassette.

Since the equal potential state of the surface potentials of the developing roll 2 and the magnetic roll 1 can be realized when the potential difference 30 (|7*a*–8|) of both surface potentials is brought to 0 V, both potentials may be brought to 0 V, for example or to any arbitrary potentials such as 50V. The equal potential state may be realized by controlling the surface potentials of both the developing roll 2 and the magnetic roll 1, by adjusting one surface potential equal to the other surface potential or further by making equal potential states for a partial period of the image-non-forming period but not for all the image-non-forming period.

By realizing an equal potential state at the image-non-forming period or at before beginning of forming an image while the developing roll, the magnetic roll and the paddle mixer is rotated, electrostatic force with which toner stick to the developing roll vanishes. As a result, the residual toner can effectively be recovered to the magnetic roll with the effect of magnetic brush owning to the circumferential difference between the developing roll and the magnetic roll without imposing a load on toner. The residual toner that is a cause of ghost is easily recovered so as to avoid fogging and ghost whereby a clear image can be obtained.

Furthermore, in the present embodiment, the toner which has not been used on developing the latent image on the photosensitive body in toner of the toner thin layer on the developing roll 2, that is the residual toner after development is recovered with the brush effect generated by circumferential rate difference of the rolls wherein the magnetic brush formed on the magnetic roll is contacted to the developing roll. The recovered toner recovered with the magnetic brush on the magnetic roll 1 can be mixed with new toner by scraping the magnetic brush with the paddle of the paddle mixer 22. The mixed developer material is supplied again to the developing roll 2 so that toner is easily recovered and replaced without installing a special instrument such as a scraper blade.

Carrier used in the developing unit, according to the present embodiment, is ferrite carrier having a volume resistivity of $10^7$ Ωcm, a saturated magnetization of 70 mA $m^2$/g and an average particle size of 35 μm. Among carriers having high magnetization and low resistivity are magnetite, Mn series ferrite and Mn—Mg series ferrite. Though these carriers can be used as they are, it is possible to use surface treated examples of them as long as their resistivity is maintained at a low level. The carrier has the role of recovering the residual toner and then supplying toner. The carrier can peel off toner stuck firmly with an electrostatic force by the nip between the developing roll 2 and the magnetic roll 1 to supply the necessary toner for development as long as its resistivity is within the range of $10^4$–$10^7$ Ωm.

It is preferable, in this case, to use small particle sized carrier having a large surface area in order to increase contact points with toner particles. If the resistivity of the carrier is $10^4$ Ωm or lower, it is difficult to apply accurate charge to toner to maintain development without fogging but effective to cope with ghost, further, toner would scatter to contaminate the charger or the exposure unit 57 in case of a long run of copying. If the resistivity of the carrier is $10^7$ Ωm or higher, it is possible to give charging ability but it has a problem that toner charge becomes higher. Properly charged toner can be replenished while recovering toner on the developing roll.

Meanwhile, toner scattering and fogging are prevented by controlling toner charge to 5–20 μC/g. A development hysteresis phenomenon is not left on the developing roll 21 by developing at low electric field. Thereby, a developing system that has a good recoverability of toner can be provided. Charged toner together with carrier form magnetic brush on the magnetic brush. The toner layer is formed on the developing roll 2 by the potential difference 30 (|7*a*–8|) between the magnetic roll 1 and the developing roll 2. Toner flies to the photosensitive body 3 by a combined bias of a direct current bias plus an alternating bias.

The residual toner on the developing roll 2 is recovered with the brush effect born from the difference of the circumferential rotating rate of the both rolls while the magnetic brush on the magnetic roll contacts the toner layer on the developing roll. By stirring with a paddle mixer 22, toner is easily recovered and replaced without installing a special instrument such as a scraper blade.

As for a mixing ratio of toner in the present embodiment, a total mixture of carrier and toner contains 2–40 weight % of toner, preferably 3–30 weight %, and more preferably 4–25 weight %. If a mixing ratio of toner is less than 2 weight %, toner charge increase to be unable to obtain enough image depth. If a mixing ratio of toner is more than 40 weight %, enough toner charge cannot be obtained so that toner scatters from the developer to contaminate the inner part of the image forming apparatus or generates fogging on the image.

In the present embodiment, to enhance the replacement of developer material, the magnetic roll 1 is rotated faster than the developing roll and the rate of the magnetic roll 1 is less than 2 times that of the developing roll 2 so as to recover toner on the developing roll. Supplying developer material, a toner concentration of which is adjusted to appropriately, to the developing roll 2, can form a uniform toner layer.

When a positively charged organic photosensitive body (OPC) is used as a photosensitive body 3, the DC developing bias 7*a* is brought to 500 V or lower, preferably 400 V or lower in order to prevent to apply a strong electric field to toner.

Thus, to set the developing bias low is effective for preventing dielectric breakdown of a thin film of a-Si photosensitive body and excessive charge of toner. A toner layer of 10–100 μm, preferably 30–70 μm is formed on the developing roll 2 and a gap between the developing roll 2 and photosensitive body 3 is set to 150–400 μm, preferably 200–300 μm. Clear images are formed by flying toner on the photosensitive body 3 through the gap with direct plus alternating current electric field.

A gap between the restricting blade 9 and the magnetic roll 1 is set to 0.3–1.5 mm. A gap between the magnetic roll 1 and the developing roll 2 is likewise set to 0.3–1.5 mm. A thickness of the toner thin layer on the developing roll is set to 6–100 μm, preferably 30–70 μm. This thickness corresponds to 5–10 layers of toner particle when an average particle size of toner is 7 μm. A gap between the developing roll 2 and the photosensitive body 3 is 150–400 μm, preferably 200–300 μm. A gap narrower than 150 μm causes fogging. If the gap is broader than 400 μm, it is difficult to cause sufficient toner to jump across to the photosensitive body so that sufficient image depth can be obtained. Further, it causes a selective development.

With this method of the present embodiment, using a test machine of a tandem type image forming apparatus shown in FIG. 5, an evaluation was made by printing at a process speed of 84 mm/sec and 14 sheets/min. A numeral 30 in FIG. 18 indicated a model of the potential difference between the magnetic roll 1 and the developing roll 2 in this case. A numeral 40 in FIG. 19 indicated the toner weight on the developing roll 2 in this case. To prevent developing ghost and maintain stable depth even if high depth printings are successively performed, enough toner of 1.0 mg/cm$^2$ or more should be assured from at the first round of rotation of the developing roll 2. In the present embodiment, toner of 1.0 mg/cm$^2$ or more could be assured from at the first round and a stable printing was possible.

With the developing method of the present embodiment, necessary toner amount can be obtained from at the first round of rotation of the developing roll 2, accordingly, the ghost shown in FIG. 4 is prevented from appearing. Thus, in the developing method of the present embodiment, the developing roll is not rotated idly to the next developing timing or enough developing interval is not taken, as is the case in the usual method. Increased load to the developer material, deterioration of the toner charge, decline of the printing rate and decline of developing property by the selective development do not occur. Thereby, developing amount of each color can be kept constant so as to maintain an excellent developing property.

As it is apparent by the above explanation, according to the present embodiment, the toner layer on the developing roll can be made uniform by controlling the potential difference between the developing roll and the magnetic roll in the hybrid type developing unit in spite of a compact tandem type color apparatus. A developing hysteresis is suppressed by equalizing the potential difference at timing out of developing and toner charge is stabilized whereby clear images are obtained. Even in case of printing a mixture of color images and monochromatic images, developing amount of each color can be maintained constant so that an excellent developing property can be maintained.

According to the present embodiment, when the toner thin layer is formed for developing the latent image on the photosensitive body, by setting the potential difference between the first and the second direct current bias at the toner thin layer forming period of the first round greater than that at the toner thin layer forming period of the second round or after, those phenomena which a toner amount of the toner layer on the developing roll at the beginning of the second round is varied from that at the first round and the image depth is decreased at the second round or after because of a lack of an absolute amount of toner after developing a deep depth image are prevented, which are heretofore occurred in case the potential difference of the second round or after is the same as that of the first round. Further, a toner amount of the layer necessary for the first round development of the developing roll is assured while an image depth after deep depth developing is not lowered due to a lack of absolute amount of toner.

Consequently, a control method in a developing unit can be provided, a developing unit in which the appearance of a ghost image can be prevented and a stable image quality can be maintained for a long time without varying toner amount or lowering image depth by supplying surely charged toner to the developing roll, whereby a tandem image forming apparatus capable of stabilizing a image quality can be constructed compactly and at low cost.

Further according to the present embodiment, when a potential difference at the first round that is higher than that at the second round or after is set to higher than 50 V, a toner amount on the developing roll increases, which causes toner scattering. When it is set to lower than 50 V, apparent effect cannot be seen. These phenomena can be avoided by setting to approximately 50 V. Thereby, coping with the aforementioned phenomena, a necessary amount of toner can be assured while the phenomenon that an image depth is lowered because of lack of absolute amount of toner after developing a deep depth image is prevented.

Further according to the present embodiment, by generating an equal potential state wherein the first and the second bias are equalized as rotating the developing roll and magnetic roll at the image-non-forming period while the alternating bias alone is applied, residual toner can be recovered with the brush effect of circumferential rotating rate difference of rolls as contacting magnetic brush on the magnet roll to the toner layer on the developing roll without installing a particular instrument such as a scraper blade and developer material can be replaced by stirring with the stirring mixer. Therefore, residual developing toner that causes a ghost is recovered with ease and a clear image can be formed by preventing appearing ghost while avoiding generating fogging.

Figure 20:
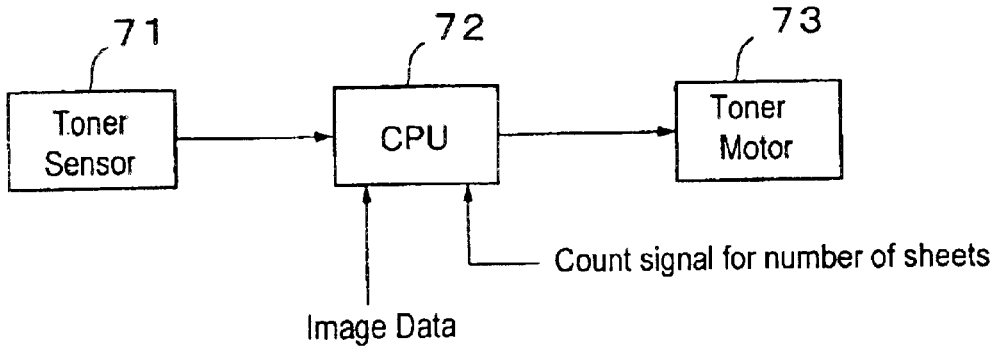
FIG. 20 is a block diagram showing one embodiment of developer material replenishing control circuit according to the present invention.

Another embodiment having a toner replenishing control apparatus according to the present invention is explained as follows. As shown in FIGS. 10 and 20, the developing unit has a toner container 24 with a replenishing roll 25 in the upper part of the developing vessel 12 and a toner sensor 71 on the developing vessel wall confronting a stirring mixer 23 in the developing vessel, a toner sensor 71 is fixed to the developing vessel 12. The toner sensor 71 is connected to a control part (CPU) 72. The CPU 72 controls a toner motor 73 to rotate the replenishing roller 25 so as to replenish toner to the developing vessel 12 from the toner container 24 as stated hereinafter.

As shown in FIG. 5, when the exposure unit 57 exposes the photosensitive drum 55, i.e. when the exposure unit 57 is driven, an exposure unit driving signal is given to the exposure unit 57. For example, a manuscript is read by a scanner (CCD; not shown) and an output signal is taken as an image signal (an image data). The image data is expressed as a dot matrix. An exposure unit driving signal corresponding to the image data is given to the exposure unit 57. The photosensitive drum 55 is exposed based on the image data. In an example of drawing, the image data is given to the CPU 72. A printed sheets count signal which indicates a print sheets number is given to the CPU 72.

Figure 21:
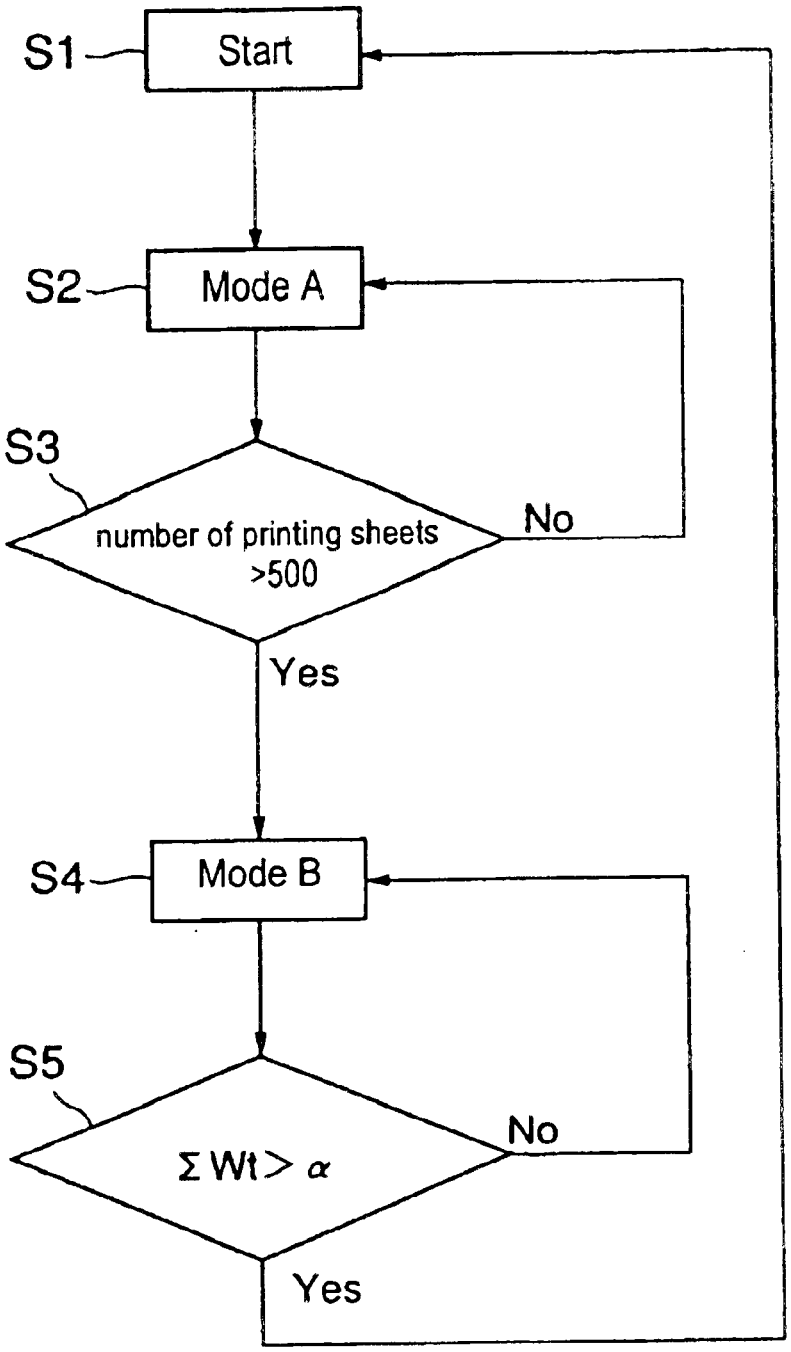
FIG. 21 is a flow sheet illustrating an activation of developer material replenishing control apparatus shown in FIG. 20.

Referring to FIG. 21, when the image forming apparatus starts (step S1), CPU 72 reacts with mode A (step S2). In mode A, CPU 72 subjects the toner motor 73 to on-off control according to a toner detecting signal given from the toner sensor 71. That is to say, the toner sensor 71 watches the toner amount in the developing vessel 12 and transmits a low level signal when the toner amount comes to under the prescribed amount. When the CPU 72 receives the low level signal, it makes the toner motor 73 on. Thereby the replenishing roller 25 is rotated so that toner is replenished at a prescribed interval to the developing vessel 12 from the toner container 24. The toner sensor 21 transmits a high level signal when the toner amount in the developing vessel 12 is more than a prescribed amount. When the CPU 72 receives the high level signal, it makes the toner motor 73 off. Thereby toner replenishment from the toner container 24 to developing apparatus is stopped. Thus, toner amount in the developing vessel 12 is controlled to stay within predetermined limits.

As mentioned before, as a printed sheets count signal is given to the CPU 72, the CPU 72 knows a printed sheets number. When the number of sheets to be printed exceed the prescribed number (e.g. 500 sheets) (step S3), the CPU 72 shifts to mode B (step S4).

With mode B, the CPU 72 stops the toner replenishment regardless of the toner amount detecting signal. The CPU 72 measures an image density at every image data based on a count of the number of dots in the image data to obtain a measured image density (Wt). CPU 72 adds successively the measured image densities to obtain an added image density ($\Sigma$ Wt). For example, the CPU 72 calculates the added image density ($\Sigma$ Wt) by the equation added image density ($\Sigma$ Wt)=measured image density×printed sheets number. The CPU 72 judges whether the added image density exceeds a prescribed value ($\alpha$) or not (step S5). When the added image density exceeds a prescribed value ($\alpha$), the CPU shifts to step S1 and reacts with mode A.

As stated above, an image density is measured from the number of dots and measured image densities are added to obtain an added image density. Toner is replenished till the added image density exceeds a prescribed value and after that toner is stopped to replenish. In other words, a relation of the added image density with the toner consuming amount is defined beforehand and the toner consuming amount is estimated based on the added image density. That is, the CPU 72 measures an image density at every image data, adds successively the measured image densities to obtain an added image density and estimates a toner consuming amount. The CPU 72 forbid replenishing of toner for the forbidden time of until toner consuming amount comes to a prescribed amount. Consequently, toner (large and old toner particles) near the developing roll 2 is consumed.

It is an effective means to operate appropriately (e.g. in case an average printing density comes to a prescribed value) a recovering action, so called a dummy developing, that toner on the developing roll is transferred to the photosensitive drum 55 and after that toner is recovered with an unshown cleaner at the time of image-non-forming period in mode B.

As it is easily understood from the aforementioned explanation, a time period while the mode B is executed is determined as added image density ($\Sigma$ Wt)=(measured image density×printed sheets number). If the time period is determined, a ripple of toner amount in the developing vessel 12 can be controlled regardless of a measured image density. (A ripple of toner amount herein is defined as (1) decreasing ratio of toner amount in mode B to the amount that is controlled to approximately prescribed amount in mode A in the developing vessel 12 or (2) decreasing ratio of toner amount in the vicinity of sleeve 33 in mode B to the amount that is controlled to approximately prescribed amount in mode A in the developing vessel 12.) Namely, if a time period of executing mode B is determined only with respect to printed sheets number, a ripple rate of toner amount is turned to small since a consuming amount of toner in the vicinity of developing roll 2 is little in case low measured image density. Further, if an image density is high, a toner consuming amount in the vicinity of the developing roll increases so that a ripple rate of toner amount is turned to high. (i.e. toner amount in the vicinity of the developing roll 2 decreases) As a result, the toner thin layer is not formed on the developing roll 2.

Figure 22:
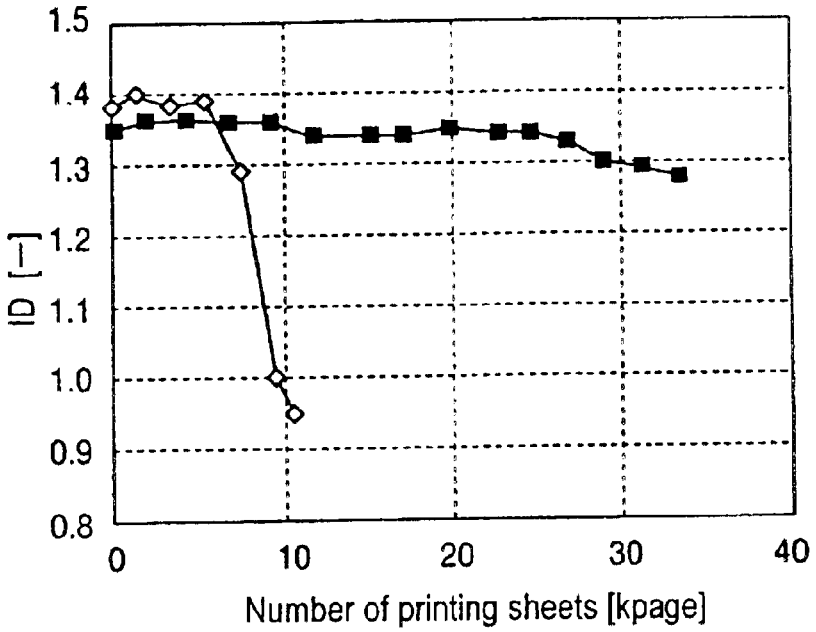
FIG. 22 is a graph explaining the relation of the number of printed sheets shown in FIG. 20 to an image depth.

Now, referring to FIG. 22, image depth changes in case of a conventional toner replenishing control (conventional example) and a toner replenishing control (the present replenishing control) according to the present invention explained in FIG. 21 are explained herein. In FIG. 22, a curve with ◇ indicates a conventional example; a curve with ■ indicates the present replenishing control. As easily seen in FIG. 22, when a printing sheets number exceeds 7000–8000, the image depth abruptly lowers in the conventional example, while even when a printing sheets number exceeds (30 000 sheets), the image depth remains stable with the present control. Using the present replenishing control increases image depth stability.

Figure 23:
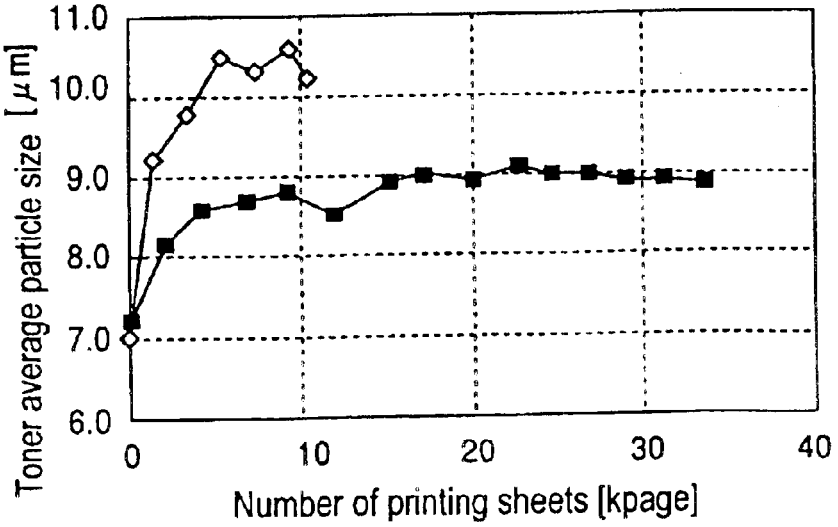
FIG. 23 is a graph explaining the relation of the number of printed sheets shown in FIG. 20 to an average particle size of toner.

Further, referring to FIG. 23, a change of toner average particle size (μm) in the developing vessel 12 (e.g. in the vicinity of the developing roll 2) in case of a conventional example and a present replenishing control is explained.

In FIG. 23, a curve with ◇ indicates a conventional example and a curve with ■ indicates the present replenishing control. As it is easily understood from FIG. 23, in the conventional example, the toner average particle size increases greatly after starting printing (after printing 100–200 sheets) and continues to increase after that. The toner average particle size varies even after 5,000 sheets have been printed. While in the present replenishing control, though the toner average particle size increases after starting printing, it is seen that the toner average particle size goes stable near after 5,000 sheets have been printed. It is also seen that there is a great difference in the toner average particle size between the conventional example and the present replenishing control. (the toner average particle size is extremely small in the present replenishing control in comparison with that in the conventional example).

As stated above, when the toner replenishing control explained in FIG. 21 is performed, as a ripple in toner amount in the developing vessel 12 is generated, the toner replenished newly to the vicinity of the developing roll 2 transfers in a short time in the developing vessel 12 on account of the ripple. As a result, old toner (large particle sized toner and deteriorated toner) is consumed while new toner is supplied to the vicinity of the developing roll 2, which results in effectively preventing the decreasing of the image depth and the fogging.

According to the experiments of the present inventor, it was found that the toner ripple rate was preferably within the range of 5–50% of the amount of toner in the developing vessel 14*a*. In case the toner ripple rate is under 5%, selective developing can not be avoided, while in case toner ripple ratio is over 50%, the forbidden time for replenishing toner comes too long so that the toner thin layer is difficult to form on the developing roll 2.

In FIG. 21, an example where CPU 72 shifts from mode A to mode B when printed sheet number exceeds the prescribed number (e.g. 500 sheets) was explained. CPU 72 may shift from mode A to mode B when the measured image depth is under the prescribed value. That is, CPU 72 may shift from mode A to mode B just before generating the decline of the depth from the prescribed value.

Therefore, in the present embodiment, since toner replenishment is forbidden on the basis of the added result which obtained by adding the image densities of the image data, old toner is consumed while new toner is supplied in the vicinity of the developer material bearing body whereby a decline of the image depth and a fogging is effectively prevented.

Further, in the embodiment of the present invention, a decline of the image depth and a fogging is effectively prevented without dummy development; as a result, toner is not wasted.

While a preferred embodiment of the invention has been described, various modifications will be apparent to one skilled in the art in light of this disclosure and are intended to fall within the scope of the appended claims.

What is claimed is:

1. An image forming apparatus having at least one developing unit that develops an electrostatic latent image on a photosensitive body, the image forming apparatus comprising:

a developing roll mounted in the developing unit;

a magnetic roll mounted in the developing unit;

a magnetic brush forming region on the magnetic roll;

a toner thin layer forming region on the developing roll, wherein the toner thin layer forming region is smaller than the magnetic brush forming region;

a high resistivity region adjacent each end of the toner thin layer forming region, the high resistivity region having resistivity higher than the toner;

a developing bias applied to the developing roll, the developing bias having a first direct current bias and an alternating current bias; and a second direct current bias applied to the magnetic roll; wherein a difference between the first direct current bias and the second direct current bias at the time of a first revolution of the magnetic roll during the toner thin layer forming period is larger than the difference between the first direct current bias and the second direct current bias at a time of the second and subsequent revolution of the magnetic roll during the toner thin layer forming period.

2. The image forming apparatus of claim 1, wherein the difference between the first direct current bias and the second direct current bias during the first revolution is in the range of 45V–55V.

3. The image forming apparatus of claim 1, wherein the difference between the first direct current bias and the second direct current bias during the image non forming period is zero.

4. The image forming apparatus of claim 3, wherein the alternating current bias comprises a rectangular wave; and the rectangular wave has a positive duty ratio when a positively charged toner is used and a negative duty ratio when a negatively charged toner is used, the positive and the negative duty ratio being smaller than forty five percent.

5. The image forming apparatus of claim 3, wherein the length of image non forming period between the passage of two successive recording media is longer than the period for the developing roll to make one complete rotation.

6. The image forming apparatus of claim 3, wherein the toner on the developing roll is replaced by rotating the magnetic roll slightly faster than the developing roll, the rotation of both rolls being in same direction, and contacting with the developing roll a magnetic brush formed on the magnetic roll.

7. An image forming apparatus having at least one developing unit that develops an electrostatic latent image on a photosensitive body, the image forming apparatus comprising:

a developing roll mounted in the developing unit;

a magnetic roll mounted in the developing unit;

a magnetic brush forming region on the magnetic roll;

a toner thin layer forming region on the developing roll, wherein the toner thin layer forming region is smaller than the magnetic brush forming region;

a high resistivity region adjacent each end of the toner thin layer forming region, the high resistivity region having resistivity higher than the toner; and a replenishing means replenishing the developing unit with a toner and a control means controlling the replenishing means, the control means comprising:

(1) a replenishing control means which detects the amount of the toner consumption rate, controls the replenishing means when the detected toner consumption rate reaches a value less than a prescribed value and replenishes the toner to the developing unit; and (2) a second replenishment control means which measures an image density of every recording sheet based on the image data, adds the image densities to obtain an added image density, estimates the toner consumption rate in accordance with the added image density and prevents the replenishment of the toner by the replenishing means until the developer material consumption rate reaches a prescribed value.

8. An image forming apparatus having at least one developing unit that develops an electrostatic latent image on a photosensitive body, the image forming apparatus comprising:

a developing roll mounted in the developing unit;

a magnetic roll mounted in the developing unit;

a magnetic brush forming region on the magnetic roll;

a toner thin layer forming region on the developing roll, wherein the toner thin layer forming region is smaller than the magnetic brush forming region;

a high resistivity region adjacent each end of the toner thin layer forming region, the high resistivity region having resistivity higher than the toner; and a replenishing means replenishing the developing unit with toner and a control means controlling the replenishing means, the control means comprising:

(1) a replenishing control means which detects the toner consumption rate, controls the replenishing means when the toner consumption rate reaches a value less than a prescribed value and replenishes the toner to the developing unit, and (2) a second replenishment control means which measures an image density of every recording sheet based on the image data, adds the image densities to obtain an added image density, and prevents the replenishment of the toner by the replenishing means until the added image density reaches a prescribed value.

9. An image forming apparatus having at least one developing unit that develops an electrostatic latent image on a photosensitive body, the image forming apparatus comprising:

a developing roll mounted in the developing unit;

a magnetic roll mounted in the developing unit;

a magnetic brush forming region on the magnetic roll;

a toner thin layer forming region on the developing roll, wherein the toner thin layer forming region is smaller than the magnetic brush forming region;

a high resistivity region adjacent each end of the toner thin layer forming region, the high resistivity region having resistivity higher than the toner;

a replenishing means for replenishing the developing unit with a toner and a control means controlling the replenishing means, the control means comprising (1) an adding means which measures an image density of every recording sheet based on the image data and adds the image densities to obtain an added image density;

(2) an estimating means which estimates a toner consumption rate in accordance with the added image density; and (3) a prevention means which prevents the replenishment of the developer material by the replenishing means until the toner consumption rate reaches to a prescribed value; wherein the adding means calculates the added image density by multiplying the image density by the number of printed sheets.

10. The image forming apparatus of claim 7, wherein the second replenishment control means calculates the added image density by multiplying the image density by the number of printed sheets.

11. A tandem type image forming apparatus having at least one developing unit that develops an electrostatic latent image on a photosensitive body, the apparatus comprising:

a developing roll mounted in the developing unit;

a magnetic roll mounted in the developing unit;

a magnetic brush forming region on the magnetic roll;

a toner thin layer forming region on the developing roll, wherein the toner thin layer forming region is smaller than the magnetic brush forming region;

a high resistivity region adjacent each end of the toner thin layer forming region, the high resistivity region having resistivity higher than the toner; and a plurality of process units corresponding to the developing units, each process unit being for a color;

a plurality of photosensitive drums corresponding to the process units; wherein an image is formed by transferring each color image from each process unit to a recording medium or an intermediate transfer body; and a first potential of the developing roll is equal to a second potential of the magnetic roll during the image non forming period when a residual toner on the developing roll is recovered by the magnetic brush.

12. The tandem type image forming apparatus of claim 11, wherein the toner is forcibly expelled from the process unit to the recording medium or the intermediate transfer body when the toner consumption rate in the process unit is less than a prescribed rate.

13. The tandem image forming apparatus of claim 11, further comprising:

a toner permeability sensor, wherein the toner is forcibly expelled from the process unit to the recording medium or the intermediate transfer body when the toner permeability sensor indicates that the toner consumption rate is lower than that estimated by a CPU by counting the number of dots per sheet.

14. The tandem type image forming apparatus of claim 12, wherein an amount of the toner expelled to the recording medium or the intermediate transfer body is measured with a developing amount detecting means for each color.

15. The tandem type image forming apparatus of claim 12, wherein the toner is transferred to pile up at a place on the recording medium or the intermediate transfer body where a recording sheet does not exist when the toner consumption rate is lower than the prescribed rate.

* * * * *